US012163760B1

(12) United States Patent
Huang

(10) Patent No.: US 12,163,760 B1
(45) Date of Patent: Dec. 10, 2024

(54) MULTI-POSITION COLLAPSIBLE STOCK ASSEMBLY

(71) Applicant: Battlearms IP, LLC, Henderson, NV (US)

(72) Inventor: George Huang, Henderson, NV (US)

(73) Assignee: Battlearms IP, LLC, Henderson, NV (US)

( * ) Notice: Subject to any disclaimer, the term of this patent is extended or adjusted under 35 U.S.C. 154(b) by 106 days.

(21) Appl. No.: 18/097,496

(22) Filed: Jan. 17, 2023

(51) Int. Cl.
*F41C 23/14* (2006.01)

(52) U.S. Cl.
CPC ..... *F41C 23/14* (2013.01)

(58) Field of Classification Search
CPC ..... F41C 23/04; F41C 23/20; F41C 23/14; F41A 11/04
USPC ..... 42/71.01–74; 89/191.01
See application file for complete search history.

(56) References Cited

U.S. PATENT DOCUMENTS 8,763,296 B1 * 7/2014 Chvala ..... F41C 23/14 42/73
9,574,846 B2 * 2/2017 Huang ..... F41C 23/02
9,766,034 B2 * 9/2017 Huang ..... F41C 23/04
D810,225 S * 2/2018 Huang ..... D22/108
10,156,420 B2 * 12/2018 Huang ..... F41A 3/66
10,247,513 B1 * 4/2019 Goldense ..... F41C 23/22
2014/0259848 A1 * 9/2014 Chvala ..... F41C 23/14 42/73
2016/0258713 A1 * 9/2016 Huang ..... F41C 23/02
2016/0305738 A1 * 10/2016 Huang ..... F41C 23/20
2017/0160047 A1 * 6/2017 Huang ..... F41A 3/66

* cited by examiner

*Primary Examiner* — Michael D David
(74) *Attorney, Agent, or Firm* — Shaddock Law Group, PC

(57) ABSTRACT

A multi-position collapsible stock assembly including at least one extension rod, wherein the at least one extension rod includes an anti-rotation engagement portion formed proximate a first end of the extension rod, wherein a longitudinal arrangement of one or more spaced apart rod dimples/detents is longitudinally aligned along a plurality of areas of the at least one extension rod, wherein each longitudinal arrangement of one or more spaced apart rod dimples/detents corresponds to a discrete rotational position of the extension rod relative to the stock; and a stock having at least one anti-rotation engagement recess formed therein, wherein the anti-rotation engagement recess of the stock corresponds to the anti-rotation engagement portion such that engagement between the anti-rotation engagement recess and the anti-rotation engagement portion resists rotational movement of the extension rod relative to the stock.

20 Claims, 17 Drawing Sheets

FIG. 11
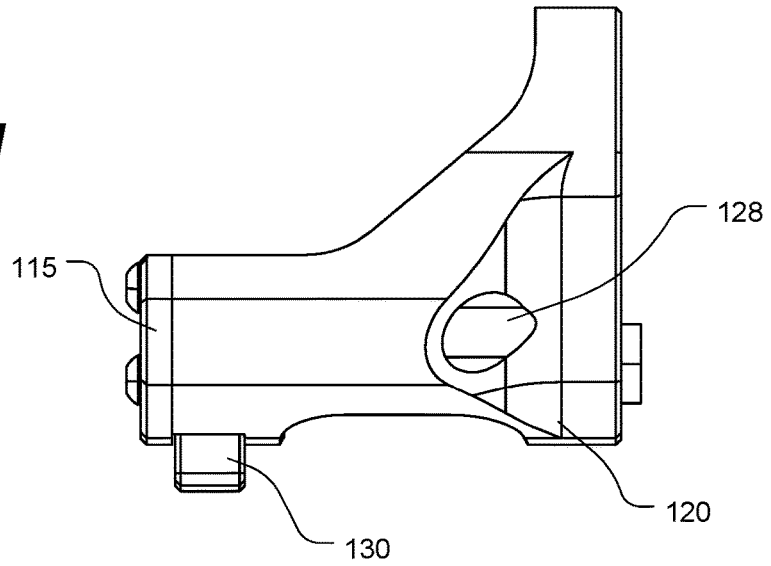
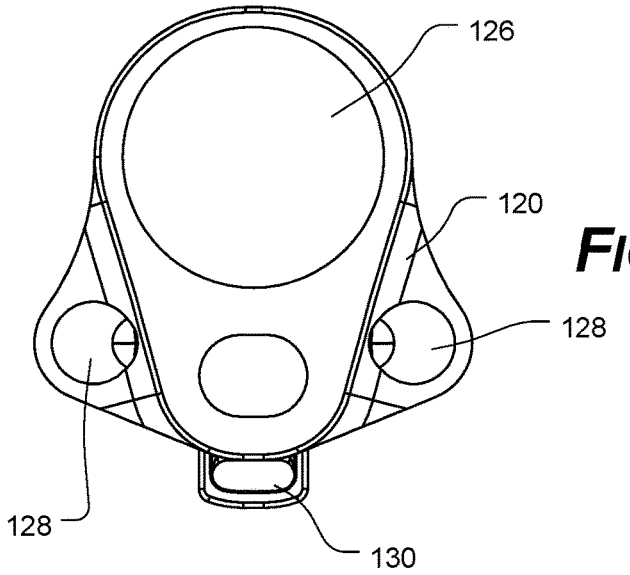
FIG. 12
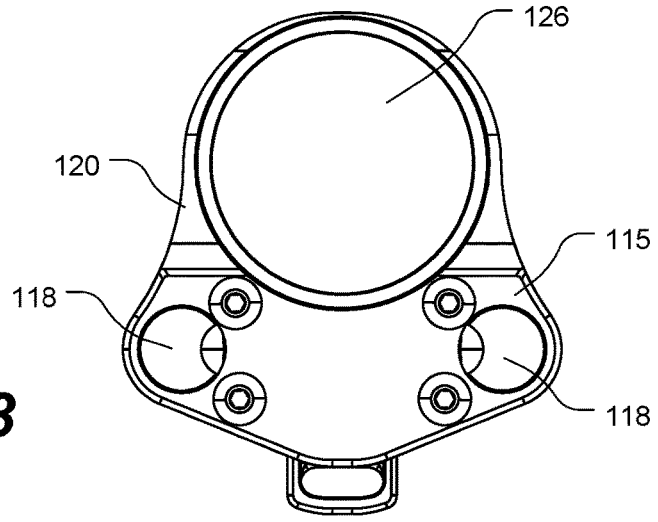
FIG. 13

MULTI-POSITION COLLAPSIBLE STOCK ASSEMBLY

CROSS-REFERENCE TO RELATED APPLICATIONS

Not Applicable.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

NOTICE OF COPYRIGHTED MATERIAL

The disclosure of this patent document contains material that is subject to copyright protection. The copyright owner has no objection to the reproduction by anyone of the patent document or the patent disclosure, as it appears in the Patent and Trademark Office patent file or records, but otherwise reserves all copyright rights whatsoever. Unless otherwise noted, all trademarks and service marks identified herein are owned by the applicant.

BACKGROUND OF THE PRESENT DISCLOSURE

1. Field of the Present Disclosure

The present disclosure relates generally to the field of firearms. More specifically, the present disclosure relates to a multi-position collapsible stock assembly for a firearm.

2. Description of Related Art

The AR-15 is based on the AR-10, which was designed by Eugene Stoner, Robert Fremont, and L. James Sullivan of the Fairchild ArmaLite Corporation in 1957. Today, there are numerous variants of the AR-15 that are manufactured by a number of companies. The AR-15 and its various related derivative platforms are used by civilians, law enforcement personnel, and military forces around the world.

Various firearms, such as, for example, the AR-15 or M-4 style firearms utilize a variable position stock 2 that is slidable and lockable at various positions along a buffer tube 5. A typical variable position stock 2 can be locked into a collapsed position, as illustrated in FIG. 1, or locked into a fully extended position, as illustrated in FIG. 2.

As further illustrated in FIGS. 3 and 4, the typical buffer tube 2 includes a capped cylindrical portion having a threaded portion 8 for installation into a firearm receiver. Typically, an endplate 6 and a lock ring 4 are utilized to complete installation of the buffer tube on the receiver. A key protrusion 7 extends from the cylindrical portion 9, typically at the 6 o'clock position. An interior portion of the key protrusion includes a plurality of spaced apart recesses or apertures that interact with a retractable bolt to lock the stock 2 in a desired position relative to the buffer tube 5.

Certain retrofit collapsible stock assemblies are available. These assemblies require use of a shortened, proprietary buffer tube and use of a proprietary bolt carrier, which includes a built-in buffer. In order to install these retrofit collapsible stock assemblies, the upper receiver must be attached to the lower receiver and the existing buffer tube and buffer retainer must be removed from the lower receiver. Next, the proprietary bolt carrier must be inserted through the buffer tube attachment aperture. Then, the proprietary bolt carrier, a proprietary buffer spring, and a proprietary stock adapter are appropriately positioned at the rear of the receiver. Once appropriately positioned, the proprietary buffer tube is then affixed to the lower receiver, via the buffer tube attachment aperture, to secure the components to the receiver.

Finally, the stock is attached to the stock adapter.

Any discussion of documents, acts, materials, devices, articles, or the like, which has been included in the present specification is not to be taken as an admission that any or all of these matters form part of the prior art base or were common general knowledge in the field relevant to the present disclosure as it existed before the priority date of each claim of this application.

BRIEF SUMMARY OF THE PRESENT DISCLOSURE

However, the typical stock can be relatively heavy and cumbersome. The known locking mechanisms used to lock the stock in a desired position along the buffer tube are awkward and difficult to operate.

As discussed above, the current retrofit collapsible stock designs require the removal of the buffer retainer and retainer spring and require the use of a proprietary bolt carrier. Because of the design of the proprietary bolt carrier, once assembled, the upper receiver of the firearm cannot be separated from the lower receiver of the firearm without removing the entire retrofit collapsible stock assembly. Thus, users are not able to separate components of the firearm, in a typical manner, for inspection or cleaning.

Furthermore, the current retrofit collapsible stock designs require use of a large stock adapter. The lower receiver was never designed for use with such a railed, collapsible stock system. Thus, the separate stock adapter adds unnecessary weight and is weaker than the one piece, monolithic stock connector component of the present disclosure.

Additionally, in variations with stock's that are slidably attached, via rails, tubes, or rods, to the firearm receiver, the rails, tubes, or rods typically include cut notches at spaced apart locations along the rails, tubes, or rods for allowing the rails, tubes, or rods (and stock) to be locked into a desired position relative to the receiver. These cut notches reduce the strength and rigidity of the rails, tubes, or rods, thereby weakening the rails, tubes, or rods, making them prone to bending.

The disadvantages and shortcomings of the prior art are overcome by the features and elements of the multi-position collapsible stock assembly of the present disclosure. The advantages of the present disclosure are preferably attained by providing, in an exemplary, nonlimiting embodiment, a bolt on collapsible stock assembly including a stock connector component and an associated collapsible stock. In various exemplary, nonlimiting embodiments, the stock connector component includes two rod apertures formed therethrough. Typically, the stock connector component includes a stock connector aperture that allows a portion of a buffer tube to be fitted through the stock connector aperture, such that the stock connector component may be attached to the lower receiver via interaction of the buffer tube and the buffer tube attachment aperture of the receiver.

The rod apertures are formed substantially parallel to the longitudinal axis of the stock connector component (and ultimately the receiver of the firearm). In certain exemplary, nonlimiting embodiments, the rod apertures are formed so as to be outside of exterior wall surfaces of the attached receiver. In other exemplary, nonlimiting embodiments, the rod apertures are formed such that mating receiving channels must be formed in adjacent exterior wall surfaces of the attached receiver. In still other exemplary, nonlimiting embodiments, the rod apertures are formed within the stock connector component so as to mate with rod apertures formed within the side walls of the attached receiver.

The rod apertures are formed so as to slidably receive the extension rods that extend from the stock.

The stock assembly comprises a stock, a cheek rest, and two extension rods. The stock comprises an elongate portion of material extending from a top end to a bottom end. A recessed channel is formed in the top end of the stock.

The cheek rest is formed of a substantially inverted "U" or "V" shaped portion of material. The cheek rest is formed so as to be permanently or releasably attached or coupled to the stock proximate the top end. When the cheek rest is attached or coupled to the stock, the space provided between the recessed channel and the cheek rest provides an aperture that allows the buffer tube to freely slide therethrough. The cheek rest is also formed so as to be positioned above and at least partially around the buffer tube that extends along a portion of the receiver.

Typical cheek rest for current retrofit collapsible stock designs leave a large gap between the buffer tube in the stock so that a user is not presented with a cheek weld. In contrast, the cheek rest provides a cheek weld for the user, whether the stock is in a collapsed or extended position.

The extension rods extend from the stock and are positioned so as to be aligned with and slidable within the rod apertures of the stock connector component. In various exemplary embodiments, the extension rods comprise a solid portion of material. Alternatively, the extension rods comprise a hollow or tubular portion of material.

In various exemplary, nonlimiting embodiments, a rod channel is formed along at least a portion of the extension rod. In various exemplary, nonlimiting embodiments, one or more rod dimples/detents are formed along the rod channel. Typically, a rod dimple/detent is formed at each terminating end of the channel and one or more rod dimples/detents are formed along the channel. Each extension rod is a mirror image of the other, such that the number and position of each rod dimple/detent of each extension rod is aligned. In this manner, each rod dimple/detent represents a lockable position of the stock relative to the receiver.

Because the majority of the strength of a rod is in the outer perimeter, by utilizing circular dimples/detents that are cut or pressed into the rod, the rod is more structurally sound than a rod having a large, flat cut across the rod.

By utilizing rod dimples/detents and a rod channel, the strength and integrity of the extension rods is maintained and the problems introduced by cut notches in existing collapsible stocks is circumvented.

A latch assembly, comprising a latch, latch springs, latch elements, and a latch cover, is attached or coupled to the stock connector component. Through interaction of the latch elements and the rod dimples/detents, the stock assembly can be releasably secured at a desired position relative to the stock connector component.

In various exemplary, nonlimiting embodiments, the present disclosure provides a multi-position collapsible stock assembly for a firearm including at least some of at least one extension rod, wherein the at least one extension rod includes an anti-rotation engagement portion formed proximate a first end of the extension rod, wherein a longitudinal arrangement of one or more spaced apart rod dimples/detents is longitudinally aligned along three or more areas of the at least one extension rod, wherein each longitudinal arrangement of one or more spaced apart rod dimples/detents corresponds to a discrete rotational position of the extension rod relative to the stock; a stock having at least one anti-rotation engagement recess formed therein, wherein the anti-rotation engagement recess of the stock corresponds to the anti-rotation engagement portion such that the first end of the extension rod of the extension rod is at least partially positioned within a portion of a corresponding anti-rotation engagement recess and engagement between the anti-rotation engagement recess and the anti-rotation engagement portion resists rotational movement of the extension rod relative to the stock; and a stock connector component, wherein at least one extension rod aperture is formed through the stock connector component, wherein each extension rod aperture is formed so as to slidably receive at least a portion of one of the extension rods, wherein the stock connector component includes interior side walls defining a connector component cavity formed so as to receive at least a portion of a latch therein, wherein the connector component cavity extends to at least one rod aperture formed therethrough, wherein each rod aperture is formed so as to be aligned with a corresponding extension rod aperture, wherein the latch extends from an engagement portion to a protrusion portion, wherein the latch is movable, along its longitudinal axis, between an engaged position and a disengaged position, wherein when the latch is in the engaged position, the protrusion portion urges at least one latch element into the rod aperture a distance that allows each latch element to seat into the spaced apart rod dimples/detents of the at least one extension rod, and wherein when the latch is in the disengaged position, the protrusion portion allows the at least one latch element to retract from the spaced apart rod dimples/detents.

In various exemplary, nonlimiting embodiments, a fastener aperture extends from each of the at least one anti-rotation engagement recess such that a fastener is positionable through at least a portion of the faster aperture to engage a fastener recess formed in the first end of the extension rod to releasably attach or couple the extension rod to the stock.

In various exemplary, nonlimiting embodiments, each anti-rotation engagement portion includes one or more surfaces forming a less than circular anti-rotation engagement portion.

In various exemplary, nonlimiting embodiments, the sidewalls of each anti-rotation engagement recess form an interior shape that matingly corresponds to sidewalls of each of the anti-rotation engagement portions.

In various exemplary, nonlimiting embodiments, each anti-rotation engagement portion includes one or more surfaces forming or defining a substantially triangular shape.

In various exemplary, nonlimiting embodiments, each anti-rotation engagement portion includes one or more surfaces forming or defining a substantially square, rectangular, pentagonal, hexagonal, or oval shape.

In various exemplary, nonlimiting embodiments, one or more surfaces forming or defining the anti-rotation engagement recess of the stock generally correspond to one or more surfaces forming or defining the anti-rotation engagement portion.

In various exemplary, nonlimiting embodiments, the engagement between the anti-rotation engagement recess and the anti-rotation engagement portion maintains the extension rod in a desired rotational position relative to the stock.

In various exemplary, nonlimiting embodiments, each rod dimple/detent is formed of a semi-spherical recess formed in a portion of the at least one extension rod.

In various exemplary, nonlimiting embodiments, each rod dimple/detent is formed of a notch or recess formed in a portion of the at least one extension rod.

In various exemplary, nonlimiting embodiments, the extension rod includes a substantially triangular anti-rotation engagement portion and an arrangement of one or more spaced apart rod dimples/detents longitudinally aligned along three areas of each extension rod.

In various exemplary, nonlimiting embodiments, each longitudinal arrangement of one or more spaced apart rod dimples/detents includes a rod channel formed between at least two of the rod dimple/detents.

In various exemplary, nonlimiting embodiments, a rod channel is formed along at least a portion of each the longitudinal arrangement of one or more rod dimples/detents, and wherein the rod dimple/detents are formed at terminating ends of the rod channel.

In various exemplary, nonlimiting embodiments, a rod channel is formed along at least a portion of each the longitudinal arrangement of one or more rod dimples/detents, and wherein each rod channel includes a rod dimple/detent formed at each terminating end of the rod channel.

In various exemplary, nonlimiting embodiments, two or more spaced apart rod dimples/detents are formed along the rod channel.

In various exemplary, nonlimiting embodiments, a number of the longitudinal arrangement of one or more spaced apart rod dimples/detents corresponds to the number of potential rotational positions of the extension rod relative to the stock.

In various exemplary, nonlimiting embodiments, the longitudinal arrangement of one or more spaced apart rod dimples/detents are positioned around a perimeter of each the at least one extension rod.

In various exemplary, nonlimiting embodiments, when the latch is in the disengaged position, the protrusion portion allows the at least one latch element to retract into the rod channels of the at least one extension rod.

In various exemplary, nonlimiting embodiments, the present disclosure provides a multi-position collapsible stock assembly for a firearm including at least some of at least one extension rod, wherein the at least one extension rod includes an anti-rotation engagement portion formed proximate a first end of the extension rod, wherein a longitudinal arrangement of one or more spaced apart rod dimples/detents is longitudinally aligned along a plurality of areas of the at least one extension rod, wherein each longitudinal arrangement of one or more spaced apart rod dimples/detents corresponds to a discrete rotational position of the extension rod relative to the stock; a stock having at least one anti-rotation engagement recess formed therein, wherein the anti-rotation engagement recess of the stock corresponds to the anti-rotation engagement portion such that engagement between the anti-rotation engagement recess and the anti-rotation engagement portion resists rotational movement of the extension rod relative to the stock; and a stock connector component, wherein at least one extension rod aperture is formed through the stock connector component, wherein each extension rod aperture is formed so as to slidably receive at least a portion of one of the extension rods, wherein the stock connector component includes a latch, wherein the latch is movable, between an engaged position and a disengaged position, wherein when the latch is in the engaged position, a protrusion portion urges at least one latch element into the rod aperture a distance that allows each latch element to seat into the spaced apart rod dimples/detents of the at least one extension rod, and wherein when the latch is in the disengaged position, the protrusion portion allows the at least one latch element to retract from the spaced apart rod dimples/detents.

In various exemplary, nonlimiting embodiments, the present disclosure provides a multi-position collapsible stock assembly for a firearm including at least some of at least one extension rod, wherein the at least one extension rod includes an anti-rotation engagement portion formed proximate a first end of the extension rod, wherein a longitudinal arrangement of one or more spaced apart rod dimples/detents is longitudinally aligned along a plurality of areas of the at least one extension rod, wherein each longitudinal arrangement of one or more spaced apart rod dimples/detents corresponds to a discrete rotational position of the extension rod relative to the stock; and a stock having at least one anti-rotation engagement recess formed therein, wherein the anti-rotation engagement recess of the stock corresponds to the anti-rotation engagement portion such that engagement between the anti-rotation engagement recess and the anti-rotation engagement portion resists rotational movement of the extension rod relative to the stock.

Accordingly, the present disclosure provides a multi-position collapsible stock assembly that allows a user to readily adjust the overall length of the stock assembly relative to the receiver, within a determined parameter.

The present disclosure separately and optionally provides a multi-position collapsible stock assembly that allows a user to readily adjust the overall length of the collapsible stock, using a relatively simple motion that is simplified relative to the current motions necessary to adjust the position of a collapsible stock.

The present disclosure separately and optionally provides a multi-position collapsible stock assembly that utilizes channels and detents that maintain the strength and integrity of the extension rods and the stock assembly.

The present disclosure separately and optionally provides a multi-position collapsible stock assembly that provides extension rods that can be secured in a variety of optional rotational positions to provide additional adjustment positions and/or links for the collapsible stock.

The present disclosure separately and optionally provides a multi-position collapsible stock assembly that can be easily manipulated by a user.

The present disclosure separately and optionally provides a multi-position collapsible stock assembly that includes a strategically positioned locking mechanism that is ambidextrous and can be operated in a single movement/motion as a user grabs the stock and engages the locking mechanism to unlock and extend the stock.

These and other aspects, features, and advantages of the present disclosure are described in or are apparent from the following detailed description of the exemplary, non-limiting embodiments of the present disclosure and the accompanying figures. Other aspects and features of embodiments of the present disclosure will become apparent to those of ordinary skill in the art upon reviewing the following description of specific, exemplary embodiments of the present disclosure in concert with the figures. While features of the present disclosure may be discussed relative to certain embodiments and figures, all embodiments of the present disclosure can include one or more of the features discussed herein. Further, while one or more embodiments may be discussed as having certain advantageous features, one or more of such features may also be used with the various embodiments disclosed herein. In similar fashion, while exemplary embodiments may be discussed below as device, system, or method embodiments, it is to be understood that such exemplary embodiments can be implemented in various devices, systems, and methods of the present disclosure.

Any benefits, advantages, or solutions to problems that are described herein with regard to specific embodiments are not intended to be construed as a critical, required, or essential feature(s) or element(s) of the present disclosure or the claims.

BRIEF DESCRIPTION OF THE SEVERAL VIEWS OF THE DRAWINGS

As required, detailed exemplary embodiments are disclosed herein; however, it is to be understood that the disclosed embodiments are merely exemplary of what may be embodied in various and alternative forms, within the scope of the present disclosure. The figures are not necessarily to scale; some features may be exaggerated or minimized to illustrate details of particular components. Therefore, specific structural and functional details disclosed herein are not to be interpreted as limiting, but merely as a basis for the claims and as a representative basis for teaching one skilled in the art to employ the present disclosure.

The exemplary embodiments of this disclosure will be described in detail, with reference to the following figures, wherein like reference numerals refer to like parts throughout the several views, and wherein:

FIG. 11 illustrates a right side view of an exemplary embodiment of a stock connector component, according to the present disclosure;

FIG. 12 illustrates a rear view of an exemplary embodiment of a stock connector component, according to the present disclosure;

FIG. 13 illustrates a front view of an exemplary embodiment of a stock connector component, according to the present disclosure;

DETAILED DESCRIPTION OF THE DISCLOSURE

Figure 1:
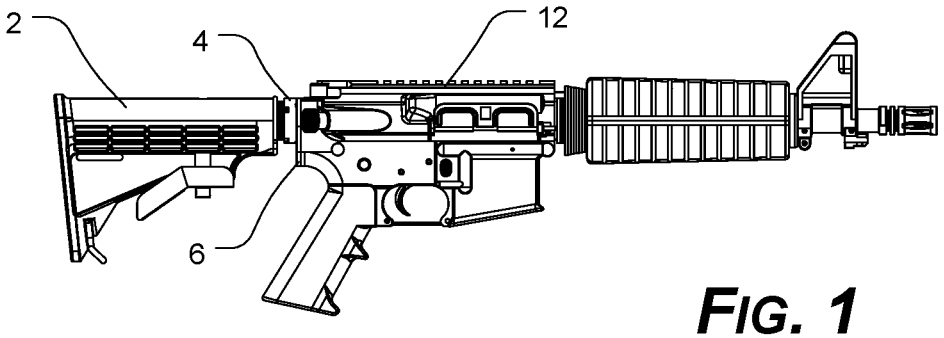
FIG. 1 PRIOR ART
FIG. 1 illustrates a side view of a standard, AR-15 or M4 style rifle having a collapsible stock, shown in a collapsed position relative to a buffer tube.
Figure 2:
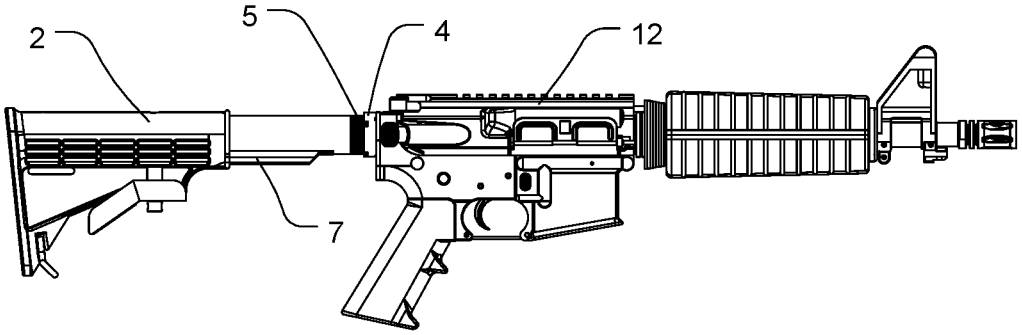
FIG. 2 PRIOR ART
FIG. 2 illustrates a side view of a standard, AR-15 or M4 style rifle having a collapsible stock, shown in an extended position relative to a buffer tube.
Figure 3:
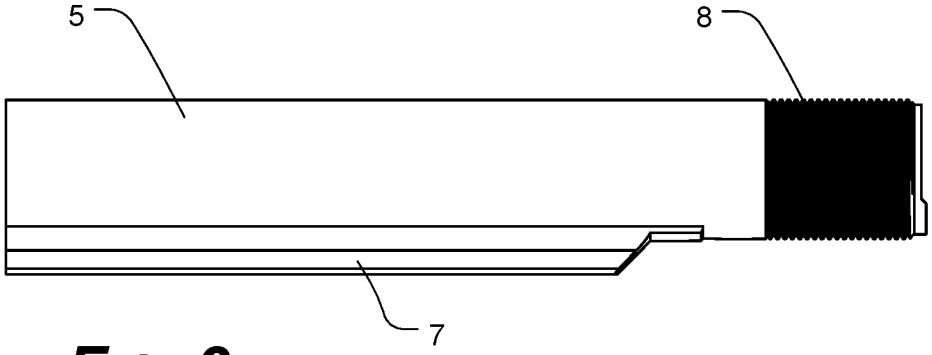
FIG. 3 PRIOR ART
FIG. 3 illustrates a side view of a standard buffer tube.
Figure 4:
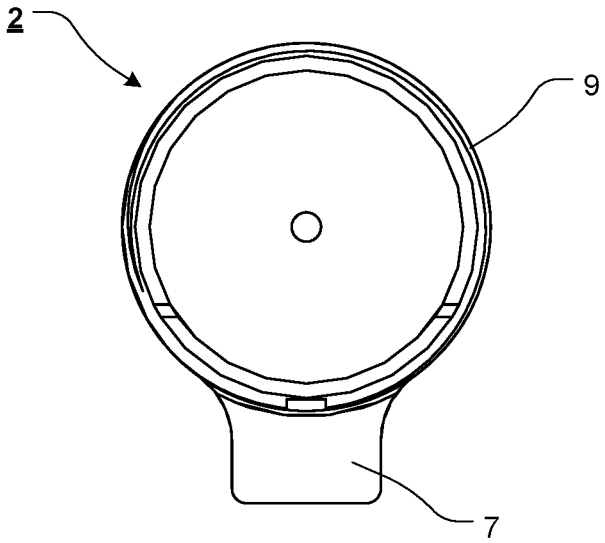
FIG. 4 PRIOR ART
FIG. 4 illustrates a front view of a standard buffer tube.
Figure 5:
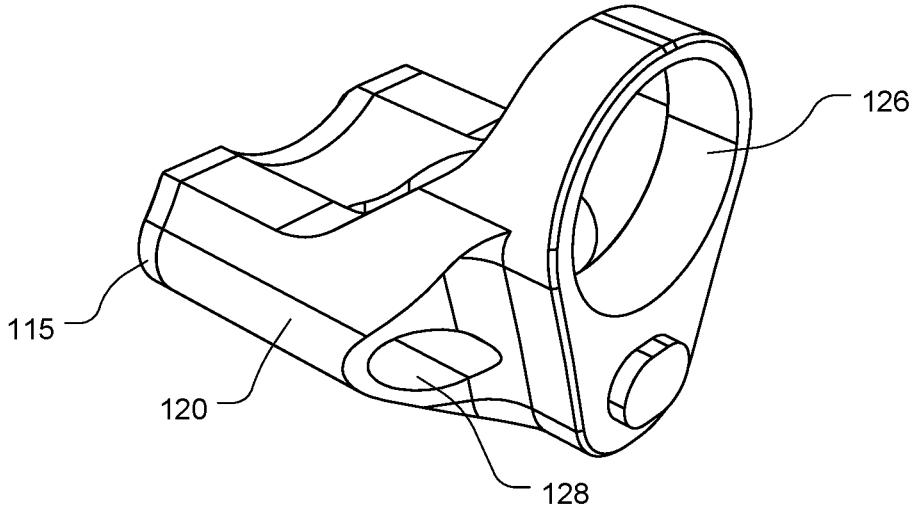
FIG. 5 illustrates an upper, right, front perspective view of an exemplary embodiment of a stock connector component, according to the present disclosure.
Figure 6:
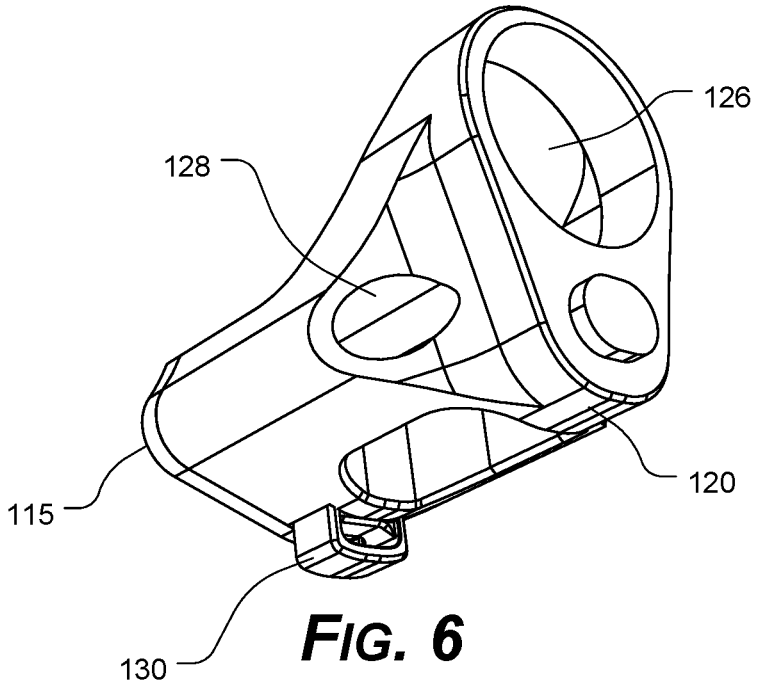
FIG. 6 illustrates a lower, right, front perspective view of an exemplary embodiment of a stock connector component, according to the present disclosure.
Figure 7:
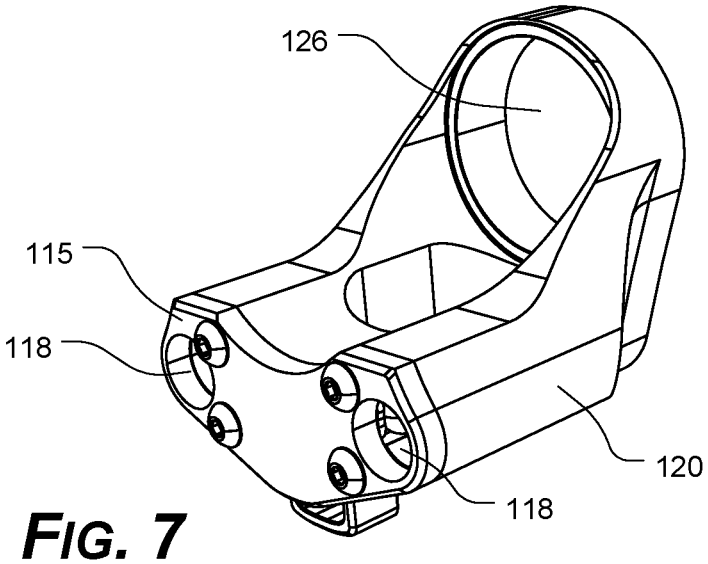
FIG. 7 illustrates an upper, right, rear perspective view of an exemplary embodiment of a stock connector component, according to the present disclosure.
Figure 8:
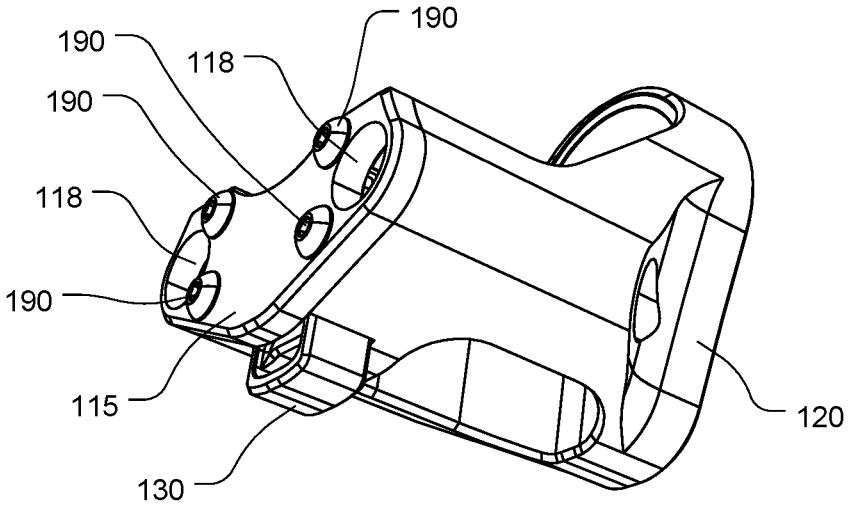
FIG. 8 illustrates a lower, right, rear perspective view of a stock connector component, according to the present disclosure.
Figure 9:
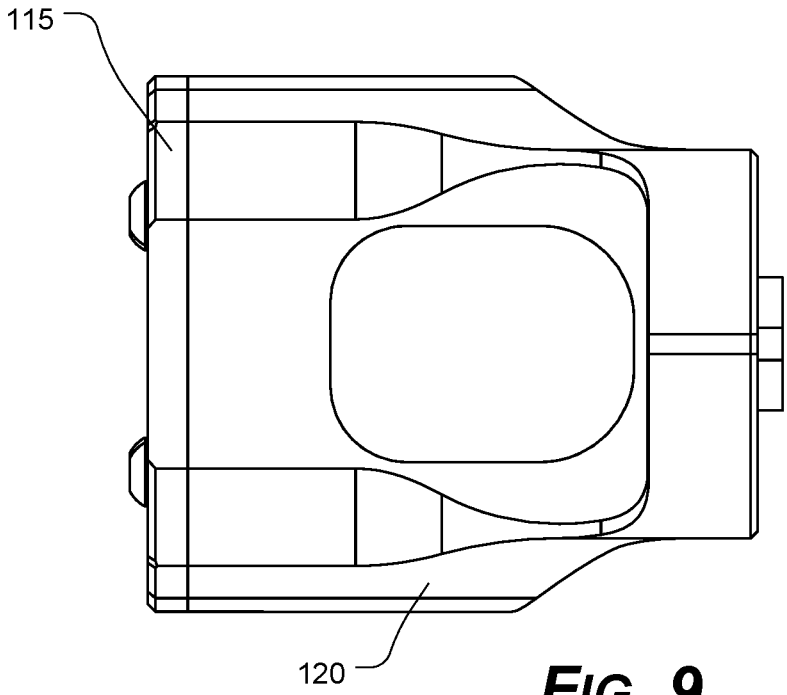
FIG. 9 illustrates a top view of an exemplary embodiment of a stock connector component, according to the present disclosure.
Figure 10:
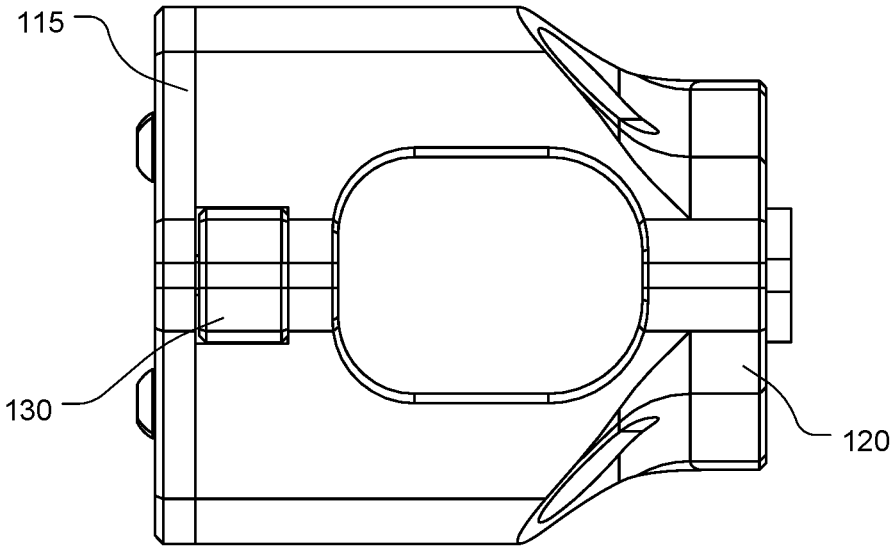
FIG. 10 illustrates a bottom view of an exemplary embodiment of a stock connector component, according to the present disclosure.
Figure 14:
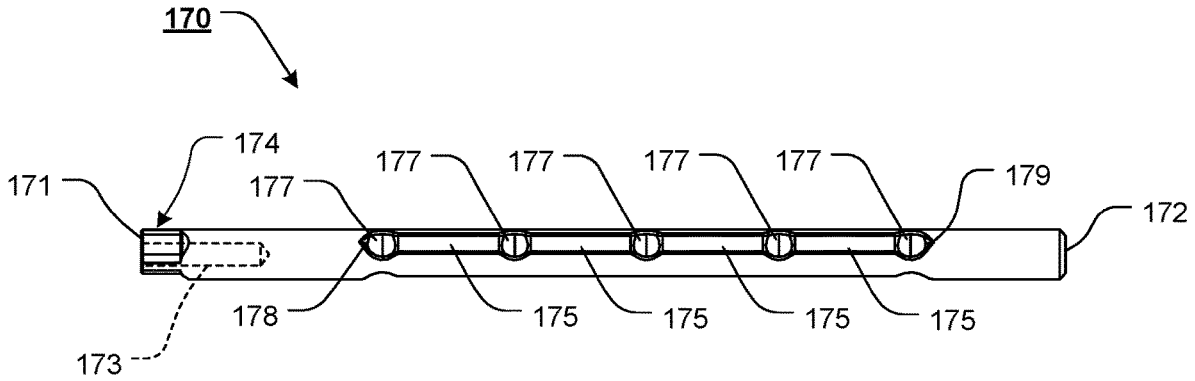
FIG. 14 illustrates a top view of an exemplary embodiment of an extension rod, according to the present disclosure.
Figure 15:
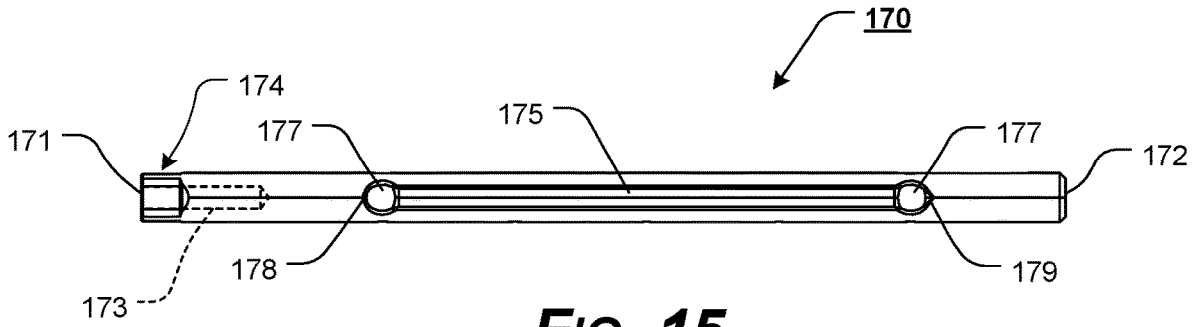
FIG. 15 illustrates a side view of an exemplary embodiment of an extension rod, according to the present disclosure.
Figure 16:
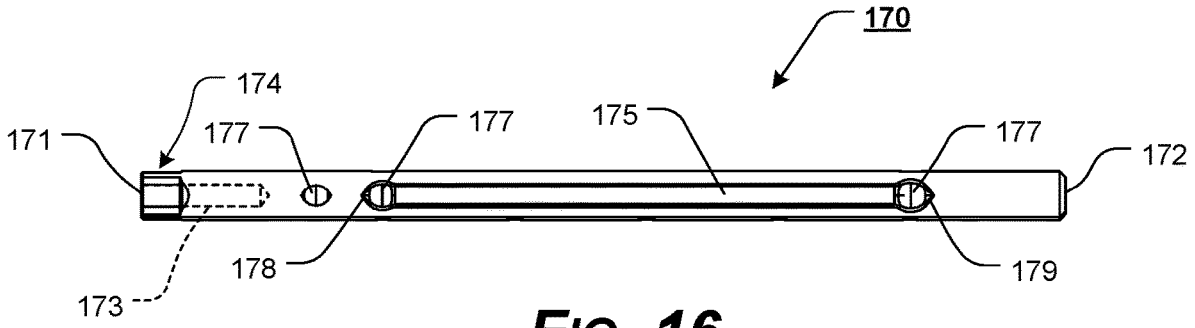
FIG. 16 illustrates a bottom view of an exemplary embodiment of an extension rod, according to the present disclosure.
Figure 17:
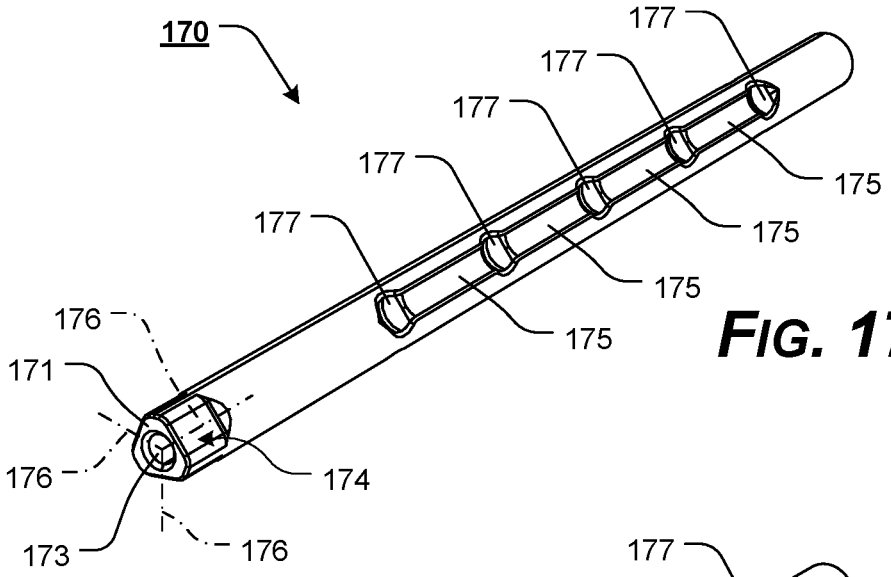
FIG. 17 illustrates a perspective view of an exemplary embodiment of an extension rod, according to the present disclosure.
Figure 18:
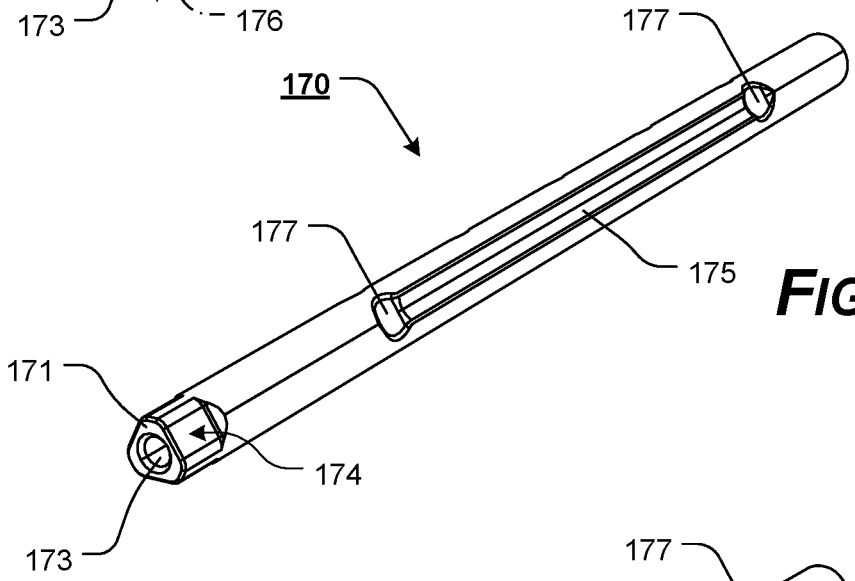
FIG. 18 illustrates a perspective view of an exemplary embodiment of an extension rod, according to the present disclosure.
Figure 19:
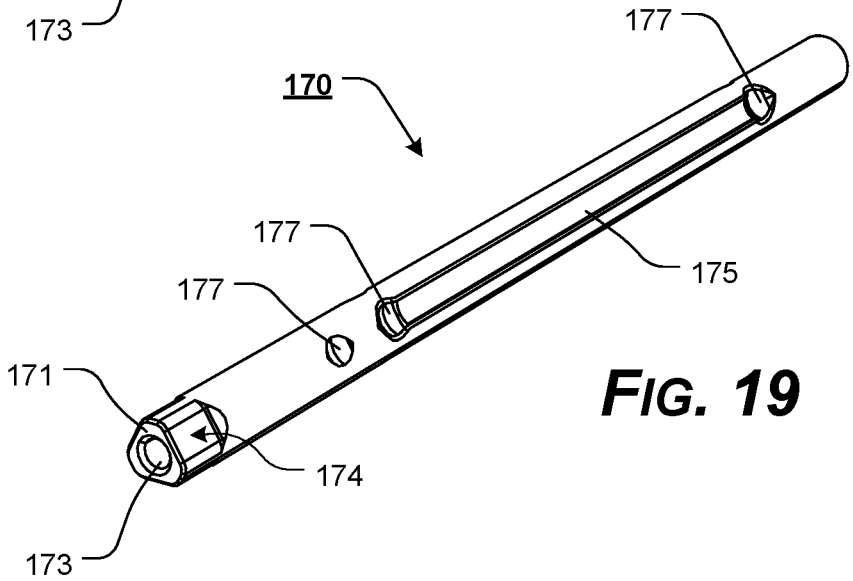
FIG. 19 illustrates a perspective view of an exemplary embodiment of an extension rod, according to the present disclosure.
Figure 20:
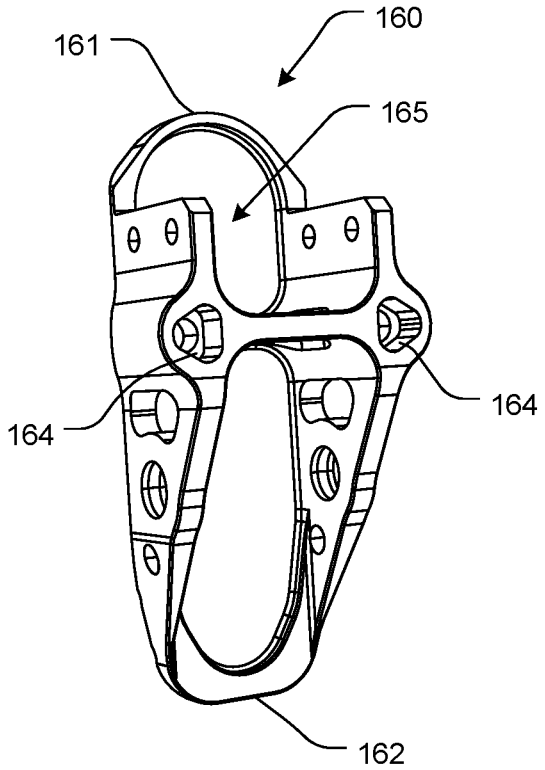
FIG. 20 illustrates a lower, front perspective view of an exemplary embodiment of a stock, according to the present disclosure.
Figure 21:
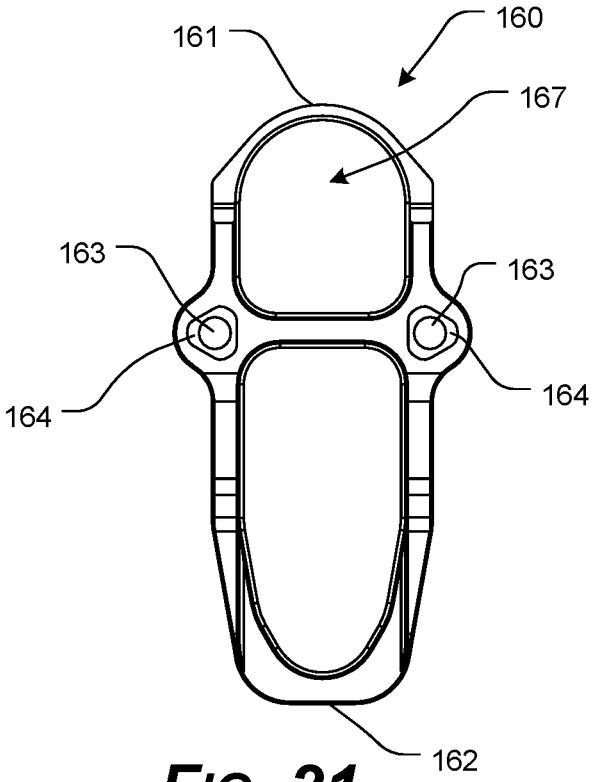
FIG. 21 illustrates a front view of an exemplary embodiment of a stock, according to the present disclosure.
Figure 22:
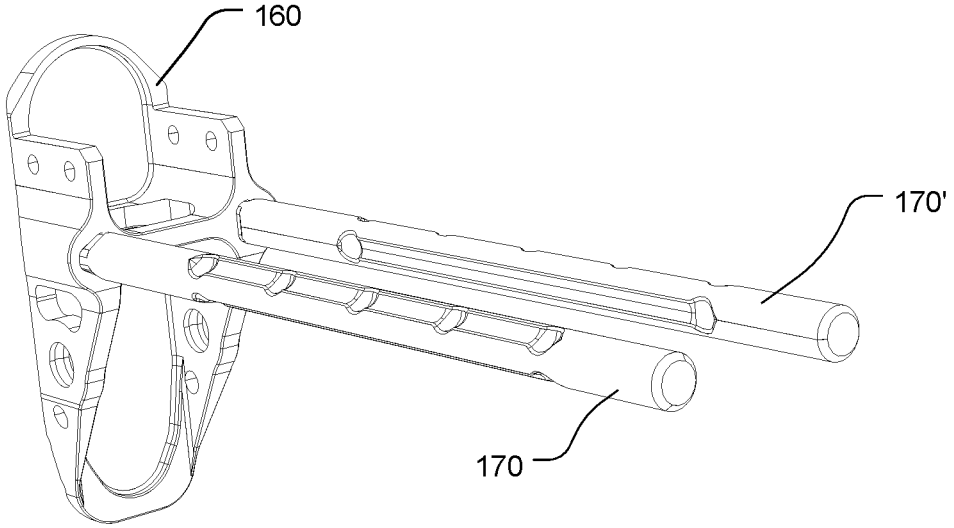
FIG. 22 illustrates a lower, front perspective view of an exemplary embodiment of a stock, with extension rods attached, according to the present disclosure.
Figure 23:
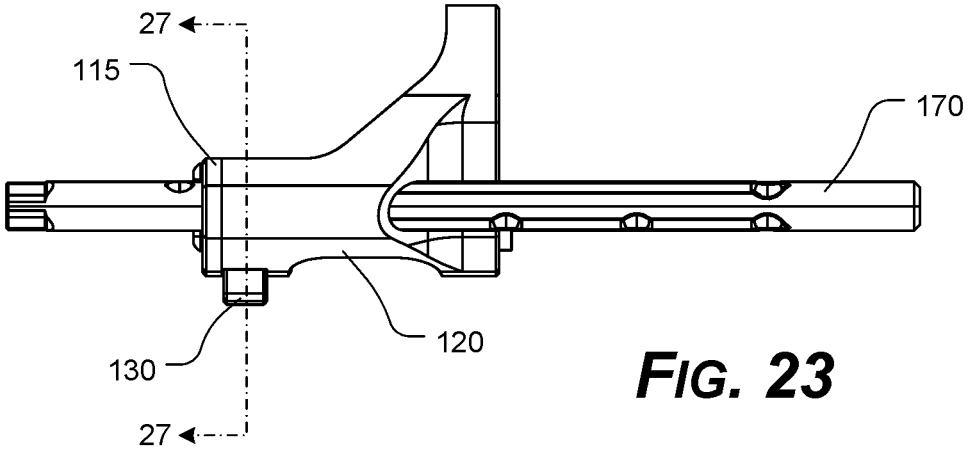
FIG. 23 illustrates a right side view of an exemplary embodiment of a stock connector component assembled together with two exemplary extension rods, according to the present disclosure.
Figure 24:
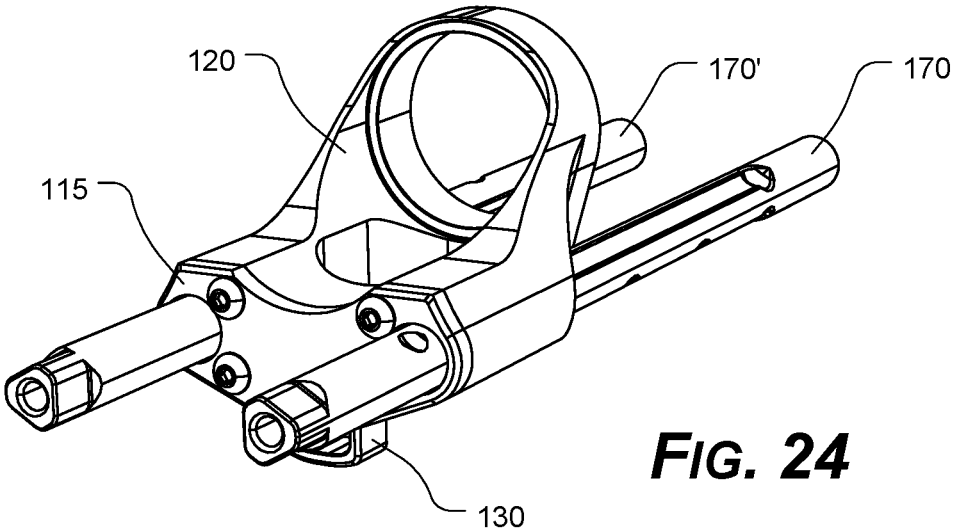
FIG. 24 illustrates an upper, rear, perspective view of an exemplary embodiment of a stock connector component assembled together with two exemplary extension rods, according to the present disclosure.
Figure 25:
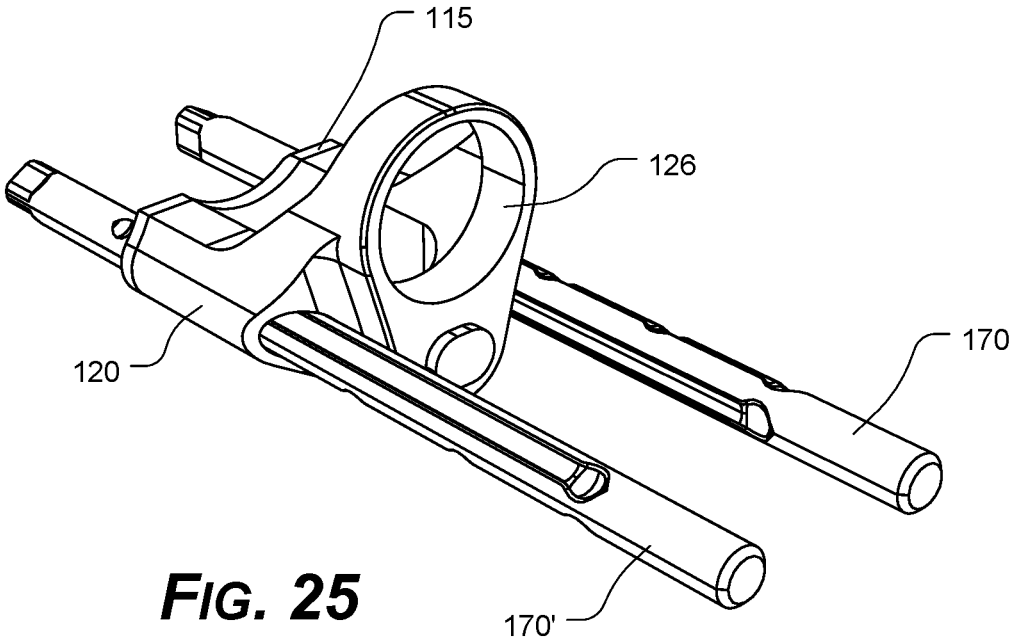
FIG. 25 illustrates an upper, front, perspective view of an exemplary embodiment of a stock connector component assembled together with two exemplary extension rods, according to the present disclosure.
Figure 26:
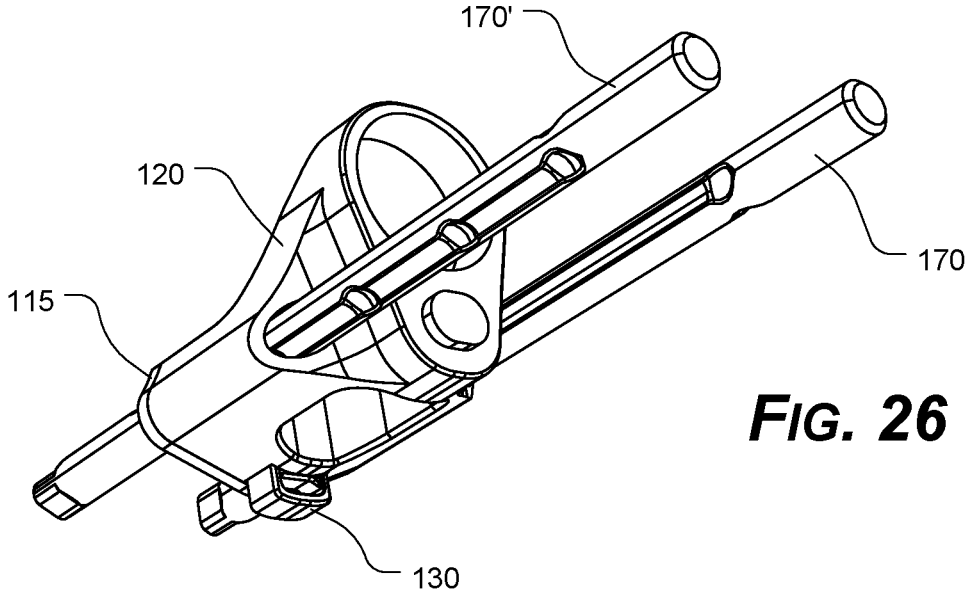
FIG. 26 illustrates a lower, front, perspective view of an exemplary embodiment of a stock connector component assembled together with two exemplary extension rods, according to the present disclosure.

The foregoing and other objectives, features, and advantages of the invention will be more readily understood upon consideration of the following description of the invention taken in conjunction with the accompanying drawings.

For simplicity and clarification, the design factors and operating principles of the multi-position collapsible stock assembly according to the present disclosure are explained with reference to various exemplary embodiments of multi-position collapsible stock assembly according to the present disclosure. The basic explanation of the design factors and operating principles of the multi-position collapsible stock assembly is applicable for the understanding, design, and operation of the multi-position collapsible stock assembly of the present disclosure. It should be appreciated that the multi-position collapsible stock assembly can be adapted to many applications where a collapsible stock assembly can be used.

As used herein, the word "may" is meant to convey a permissive sense (i.e., meaning "having the potential to"), rather than a mandatory sense (i.e., meaning "must"). Unless stated otherwise, terms such as "first" and "second" are used to arbitrarily distinguish between the elements such terms describe. Thus, these terms are not necessarily intended to indicate temporal or other prioritization of such elements.

As used herein, the word "may" is meant to convey a permissive sense (i.e., meaning "having the potential to"), rather than a mandatory sense (i.e., meaning "must"). Unless stated otherwise, terms such as "first" and "second", "right" and "left", "top" and "bottom", "upper" and "lower", and "horizontal" and "vertical" are used to arbitrarily distinguish between the exemplary embodiments and/or elements such terms describe. Thus, these terms are not necessarily intended to indicate temporal or other prioritization of such exemplary embodiments and/or elements.

As used herein, and unless the context dictates otherwise, the term "coupled" is intended to include both direct coupling (in which two elements that are coupled to each other contact each other) and indirect coupling (in which at least one additional element is located between the two elements). The term coupled, as used herein, is defined as connected, although not necessarily directly, and not necessarily mechanically. The terms "a" and "an" are defined as one or more unless stated otherwise.

Throughout this application, the terms "comprise" (and any form of comprise, such as "comprises" and "comprising"), "have" (and any form of have, such as "has" and "having"), "include", (and any form of include, such as "includes" and "including") and "contain" (and any form of contain, such as "contains" and "containing") are used as open-ended linking verbs. It will be understood that these terms are meant to imply the inclusion of a stated element, integer, step, or group of elements, integers, or steps, but not the exclusion of any other element, integer, step, or group of elements, integers, or steps. As a result, a system, method, or apparatus that "comprises", "has", "includes", or "contains" one or more elements possesses those one or more elements but is not limited to possessing only those one or more elements. Similarly, a method or process that "comprises", "has", "includes" or "contains" one or more operations possesses those one or more operations but is not limited to possessing only those one or more operations.

It should also be appreciated that, for simplicity and clarification, certain embodiments of the present disclosure may be described using terms such as "front", "back", "rear", "right", "left", "upper", "lower", "outer", and/or "inner". However, it should be understood that these terms are merely used to aid in understanding of the present disclosure are not to be construed as limiting the systems, methods, devices, and/or apparatuses of the present disclosure. Additionally, it should be appreciated that, unless otherwise stated, the design factors and operating principles of the presently disclosed multidirectional explosive disruptor system may optionally be used in a "mirror image" assembly, wherein elements shown and/or described as being included in or on an upper or identified side portion may optionally be included in or on a lower or other side portion. Alternatively, certain of the elements that are shown and/or described as being included in or on a back portion may optionally be included in or on a front portion, or vice versa.

It should also be appreciated that the terms "receiver", "stock connector component", "collapsible stock", and "firearm" are used for basic explanation and understanding of the operation of the systems, methods, and apparatuses of the present disclosure. Therefore, the terms "receiver", "stock connector component", "collapsible stock", and "firearm" are not to be construed as limiting the systems, methods, and apparatuses of the present disclosure. Thus, for example, the term "receiver" is to be understood to broadly include any upper, lower, or combined receiver for a firearm or other similar handheld or shoulder mounted device or tool.

Furthermore, it should be appreciated that, for simplicity and clarification, the multi-position collapsible stock assembly of the present disclosure will be described as being used in conjunction with a firearm, such as an AR-15 or M4 style rifle or carbine. However, it should be appreciated that these are merely exemplary embodiments of the multi-position collapsible stock assembly and are not to be construed as limiting the present disclosure. Thus, the multi-position collapsible stock assembly of the present disclosure may be utilized in conjunction with any firearm or rifle, such as, for example, an AR-10 style rifle, air rifle, paintball marker, Airsoft rifle, replica rifle, or any other tool, device, or object.

Turning now to the drawing FIGS., as discussed above, FIG. 1-4 illustrate various components of known stocks and buffer tubes. In the form of the present disclosure chosen for purposes of illustration, FIGS. 5-40 illustrate various exploded, partially exploded, and/or assembled views of certain exemplary components, elements, and/or aspects of an exemplary embodiment of the multi-position collapsible stock assembly 100, according to the present disclosure. In illustrative, non-limiting embodiment(s) of the present disclosure, as illustrated in FIGS. 5-40, the multi-position collapsible stock assembly 100 comprises a latch cover 115, a stock connector component 120, a latch 130, a cheek rest 150, a stock 160, two extension rods 170 and 170', and optionally a buffer tube 180.

The multi-position collapsible stock assembly 100 is able to be attached or coupled, via interaction of the buffer tube 180, to an exemplary lower receiver. It should be appreciated that the lower receiver can be a typical lower receiver for a firearm. It should also be appreciated that a more detailed explanation of the lower receiver, the standard features and elements of a lower receiver that are not related to the present disclosure, instructions regarding how to assemble the lower receiver, and certain other items and/or techniques necessary for the implementation and/or operation of the various exemplary embodiments of the present disclosure are not provided herein because such elements are commercially available and/or such background information will be known to one of ordinary skill in the art. Therefore, it is believed that the level of description provided herein is sufficient to enable one of ordinary skill in the art to understand and practice the present disclosure, as described.

As illustrated, the stock connector component 120 extends rearward, from a stock connector aperture 126. The stock connector aperture 126 is formed so as to allow at least a portion of a threaded portion of the buffer tube 180 to be received through the stock connector aperture 126. The buffer tube 180 includes a shoulder 182, which extends so as not to pass through at least a portion of the stock connector aperture 126. In this manner, the stock connector component 120 may be aligned with the buffer tube aperture of a lower receiver, such as, for example, the exemplary lower receiver, and, attached or coupled to the lower receiver through interaction of external threads of the buffer tube 180 and internal threads of the buffer tube aperture of the lower receiver. As the buffer tube 180 is a threaded onto the lower receiver, the interaction of the stock connector component 120 and the shoulder 182 of the buffer tube 180 secures the stock connector component 120 to the lower receiver.

Two connector rod apertures 128 are formed through the stock connector component 120, substantially parallel to the longitudinal axis $A_{LR}$ of the multi-position collapsible stock assembly 100. In certain exemplary, nonlimiting embodiments, the connector rod apertures 128 are formed so as to be positioned outside at least a portion of the exterior wall surfaces of an exemplary lower receiver to which the multi-position collapsible stock assembly 100 is attached. In other exemplary, nonlimiting embodiments, the connector rod apertures 128 are formed so as to be positioned at least partially within receiving channels formed in the exterior wall surfaces of the lower receiver to which the multi-position collapsible stock assembly 100 is attached. In still other exemplary, nonlimiting embodiments, the connector rod apertures 128 are formed so as to be positioned within the stock connector component 120 and within the side walls of the lower receiver to which the multi-position collapsible stock assembly 100 is attached. Thus, the connector rod apertures 128 may extend through the stock connector component 120 and not the lower receiver to which the multi-position collapsible stock assembly is attached, may optionally extend through the stock connector component 120 and a portion of the exterior wall surfaces of the lower receiver to which the multi-position collapsible stock assembly 100 is attached, or may optionally extend through the stock connector component 120 and be maintained within the side walls of the lower receiver to which the multi-position collapsible stock assembly 100 is attached.

The connector rod apertures 128 are formed so as to slidably receive the extension rods 170 and 170' that extend from the stock 160. In this manner, the extension rods 170 and 170' are repeatably, slidably movable within the connector rod apertures 128.

In certain exemplary, nonlimiting embodiments, the cover rod apertures 118 and/or the connector rod apertures 128 may be at least partially internally lined with a bushing or liner element (not shown), comprising a plastic, self-lubricating plastic, or other material to reduce friction between the interior walls of the cover rod apertures 118 and/or connector rod apertures 128 and the exterior surface of the extension rods 170 and 170'.

The latch cover 115 is formed so as to be attached or coupled to the stock connector component 120. In various exemplary, nonlimiting embodiments, the latch cover 115 is attached or coupled to the stock connector component 120 via one or more screws 190. Alternatively, depending upon the materials used to create the latch cover 115 and the stock connector component 120, the stock connector component 120 may be adhesively or otherwise permanently or removably attached to the latch cover 115.

Two connector rod apertures 128 are formed through the stock connector component 120, substantially parallel to the longitudinal axis $A_{LR}$ of the multi-position collapsible stock assembly 100. When the stock connector component 120 is attached or coupled to the latch cover 115, the connector rod apertures 128 are aligned with the cover rod apertures 118. In this manner, the extension rods 170 and 170' are repeatably, slidably movable within the cover rod apertures 118 and the connector rod apertures 128.

Figure 27:
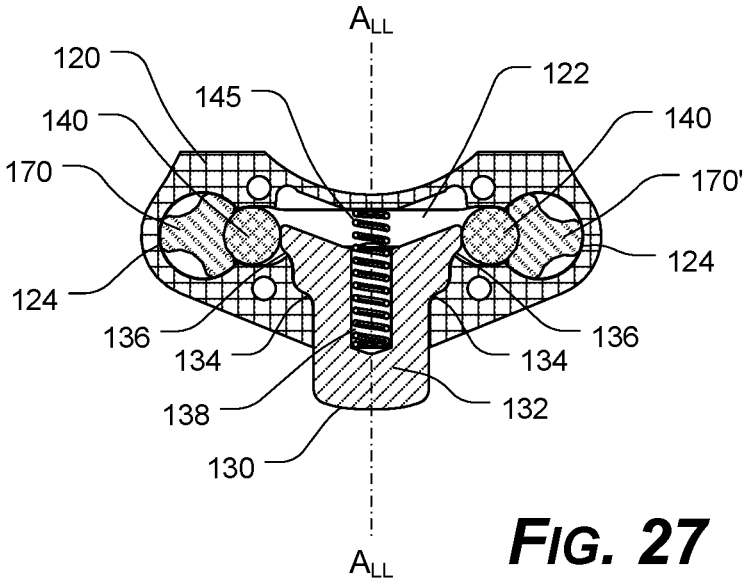
FIG. 27 illustrates a cross-sectional view taken along line 27-27 of the receiver and collapsible buttstock of FIG. 23, wherein the latch is in an engaged, or locked position, according to this invention.
Figure 28:
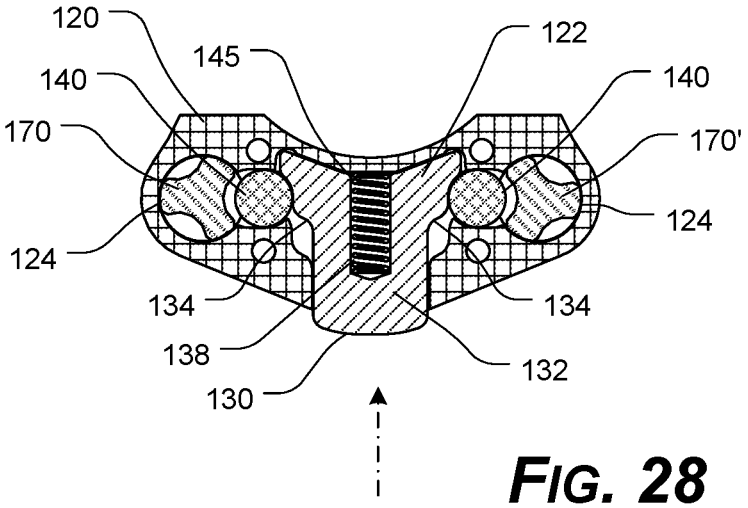
FIG. 28 illustrates the cross-sectional of FIG. 27, wherein the latch is in a disengaged or unlocked position, according to this invention.
Figure 29:
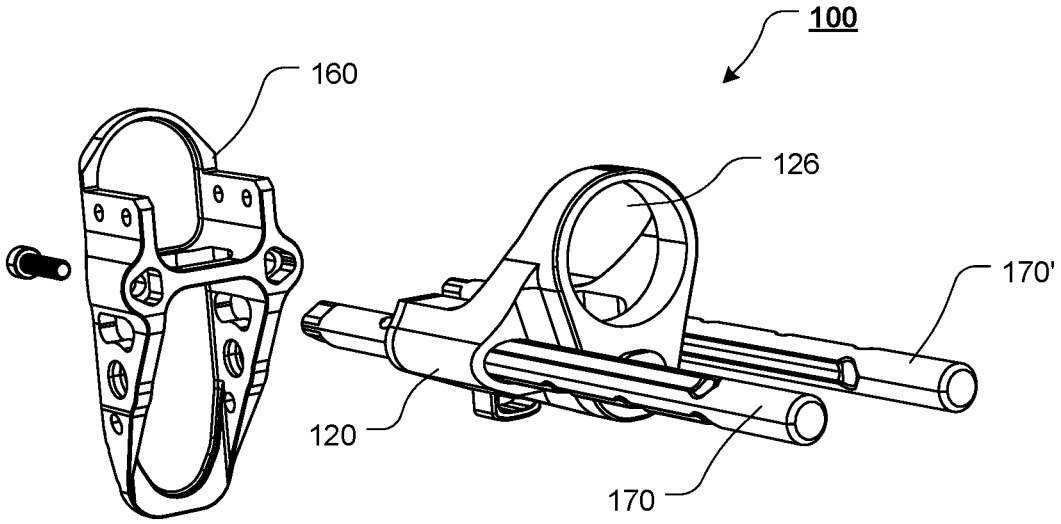
FIG. 29 illustrates an upper, front, perspective view of an exemplary embodiment of a stock connector component assembled together with two exemplary extension rods and aligned with an exemplary stock, according to the present disclosure.
Figure 30:
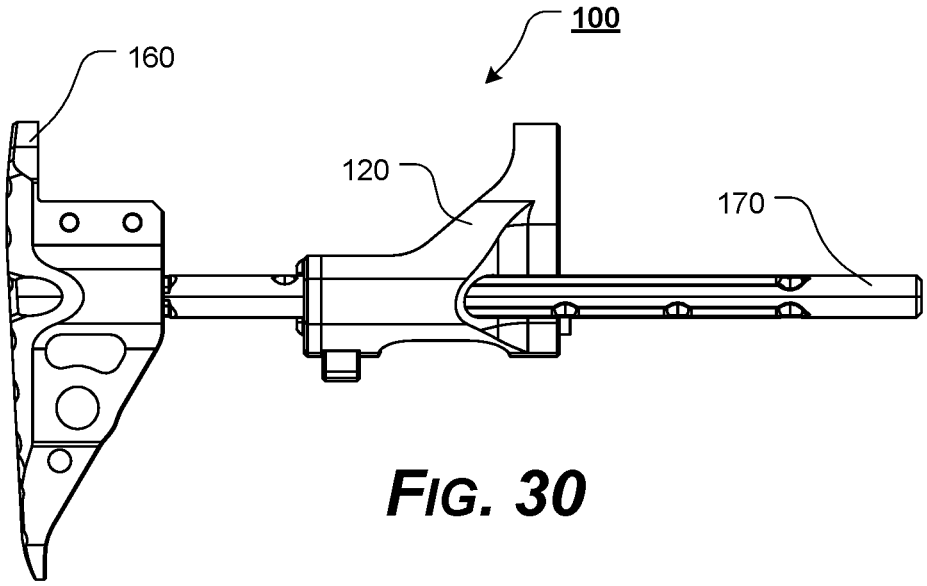
FIG. 30 illustrates a side view of an exemplary embodiment of a stock connector component assembled together with two exemplary extension rods and an exemplary stock, according to the present disclosure.
Figure 31:
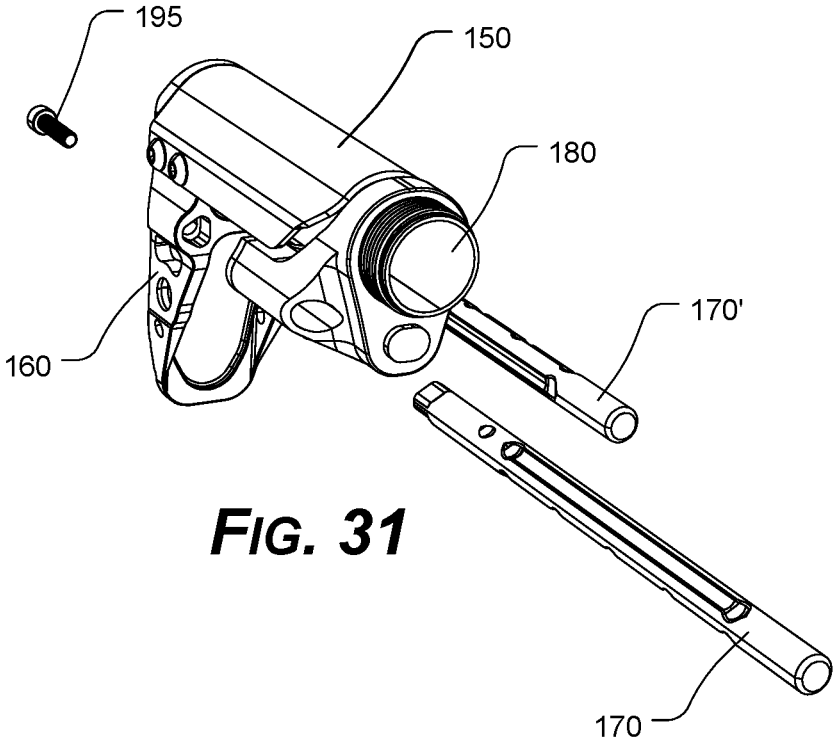
FIG. 31 illustrates an upper, front, perspective view of an exemplary embodiment of a stock connector component assembled together with one exemplary extension rod and aligned with a second exemplary extension rod, according to the present disclosure.
Figure 32:
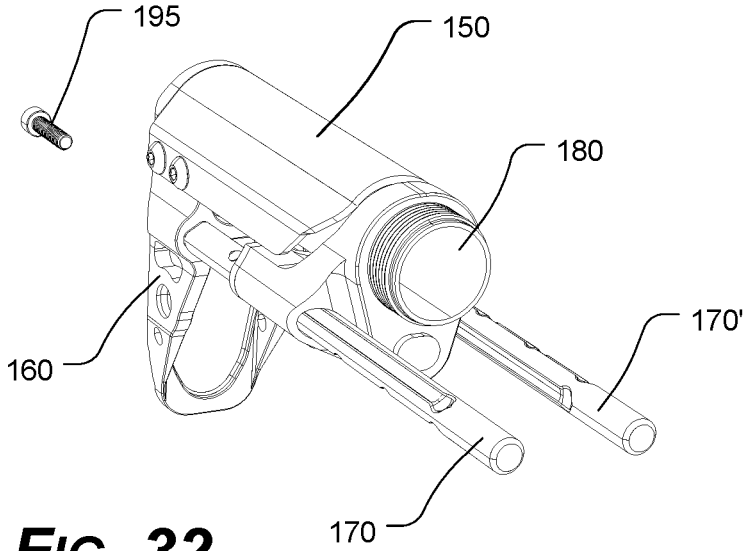
FIG. 32 illustrates an upper, front, perspective view of an exemplary embodiment of a stock connector component assembled together with two exemplary extension rods, according to the present disclosure.

As illustrated most clearly in FIGS. 27-28, the stock connector component 120 includes interior side walls defining a connector component cavity 122 formed so as to receive at least a portion of the latch 130 therein. The connector component cavity 122 includes not only space for at least a portion of the latch 130, but also connector rod apertures 128 formed therethrough. The connector rod apertures 128 are formed so as to be aligned with the cover rod apertures 118 and to slidably receive the extension rods 170 and 170' that extend from the stock 160. In this manner, when the stock connector component 120 is attached or coupled to the latch cover 115, the extension rods 170 and 170' are repeatably, slidably movable within the aligned connector rod apertures 128 and the cover rod apertures 118.

One or more gasket element(s) (not shown) may optionally be positioned between certain of the elements, such as, for example, between a portion of the latch cover 115 and the stock connector component 120. The gasket element(s) (not shown) may comprise a plastic, self-lubricating plastic, rubber, silicone, metal, carbon fiber, or other material. It should be appreciated that the material used to form the bushing or liner elements 125 and/or the gasket element(s) (not shown) is a design choice based upon the desired appearance and/or functionality of these elements.

It should also be understood that while the cover rod apertures 118 and connector rod apertures 128 (and the extension rods 170 and 170') are illustrated as having a substantially circular profile, the overall shape and/or profile of the cover rod apertures 118 and connector rod apertures 128 and the extension rods 170 and 170' is a design choice based upon the desired characteristics, functionality, and/or appearance of the cover rod apertures 118 and connector rod apertures 128 and the extension rods 170 and 170'. For example, the cover rod apertures 118 and connector rod apertures 128 and/or the extension rods 170 and 170' may have a substantially circular, square, triangular, rectangular, oblong, "L" shaped, "I" shaped, "C" shaped, "V" shaped, "Z" shaped, "T" shaped, or other profile.

Furthermore, in various exemplary embodiments, the extension rods 170 and 170' may be formed of a solid, hollow, or at least partially hollow portion of material.

Thus, the size and shape of the cover rod apertures 118 and connector rod apertures 128 and the extension rods 170 and 170' may be altered, as desired, so long as at least a portion of the extension rods 170 and 170' are able to be slidably movable within the cover rod apertures 118 and connector rod apertures 128.

FIGS. 14-19 illustrate more detailed views of the extension rods 170 and 170'. In various exemplary embodiments, the extension rods 170 and 170' are formed of a substantially cylindrical shaped portion of material that extends from a first end 171 to a second end 172. In various exemplary embodiments, the extension rods 170 and 170' comprise a solid portion of material. Alternatively, the extension rods 170 and 170' comprise a hollow or tubular portion of material.

It should be appreciated that the extension rods 170 and 170' are substantially similar in form and function. However, the extension rod 170 and the extension rod 170' may comprise mirror images of one another, such that the combination of rod channel 175 and rod dimple/detent 177 of a matched pair of extension rods 170 and extension rods 170' may optionally be utilized in conjunction with the present disclosure. It should be appreciated that the overall length of the extension rods 170 and/or 170' is a design choice based upon the desired functionality of the extension rods 170 and 170'. For example, it may be desired to lengthen or shorten the length of the extension rod 170 or the extension rod 170' to avoid or accommodate certain features of the lower receiver to which the multi-position collapsible stock assembly 100 is to be attached.

In various exemplary embodiments, each extension rod 170 and/or extension rod 170' includes an anti-rotation engagement portion 174 formed proximate the first end 171. Each engagement portion 174 includes one or more surfaces forming a less than circular anti-rotation engagement portion 174.

Fastener apertures 163 are formed through portions of the stock 160, extending from a first side of the stock 160 to a second side of the stock 160, so as to allow at least a portion of a fastener 195 to pass partially therethrough. In anti-rotation engagement recess 164 is formed in an initial portion of each of the fastener apertures 163. The sidewalls of each anti-rotation engagement recess 164 form an interior shape of each anti-rotation engagement recess 164 that matingly corresponds to the anti-rotation engagement portion 174 of each extension rod 170 and/or extension rod 170'. In this manner, during assembly, the first end 171 of each extension rod 170 and extension rod 170' is at least partially positionable within a portion of a corresponding anti-rotation engagement recess 164. Because of the mating surfaces between the anti-rotation engagement recesses 164 and the anti-rotation engagement portions 174, once appropriately positioned, each extension rod 170 and/or extension rod 170' is maintained in a desired rotational position relative to the stock 160.

In various exemplary embodiments, a fastener recess 173 is formed in the first end 171 of each extension rod 170 and/or extension rod 170'. Thus, once an extension rod 170 and/or extension rod 170' is appropriately positioned relative to the stock 160, a fastener 195 may be inserted through the associated fastener aperture 163 to threadedly engage at least a portion of the fastener recess 173 and releasably attach or couple the corresponding extension rod 170 and/or extension rod 170' to the stock 160.

As illustrated in FIGS. 37-40, the surfaces that form or define the anti-rotation engagement portion 174 may take a variety of cross-sectional shapes, when viewed from the first end 171. For example, as illustrated most predominantly herein, the surfaces that form or define the anti-rotation engagement portion 174 may have a substantially triangular shape. Alternatively, the surfaces that form or define the anti-rotation engagement portion 174 may have a substantially square, pentagonal, hexagonal, oval, or other shape. It should be appreciated that the shape of the surfaces that form or define the anti-rotation engagement recess 164 of the stock 160 generally correspond to the shape of the anti-rotation engagement portion 174, such that engagement between the anti-rotation engagement recess 164 and the anti-rotation engagement portion 174 resist rotational movement of the extension rod 170 or extension rod 170' relative to the stock 160.

In various exemplary, nonlimiting embodiments, a rod channel 175 is formed along at least a portion of each extension rod 170 and/or extension rod 170'. In various exemplary, nonlimiting embodiments, two or more spaced apart rod dimples/detents 177 are formed along the rod channel 175. Typically, a rod dimple/detent 177 is formed at each terminating end of the rod channel 175 and one or more spaced apart rod dimples/detents 177 are formed along the rod channel 175. Each extension rod 170 is a mirror image of the other, such that the number and position of each rod dimple/detent 177 of each extension rod 170 is aligned such that each rod dimple/detent 177 of a first extension rod 170 is paired with an aligned rod dimple/detent of a second extension rod 170. In this manner, each rod dimple/detent 177 represents a lockable position of the stock 160 relative to the lower receiver to which the multi-position collapsible stock assembly 100 is attached.

In certain exemplary, nonlimiting embodiments, each rod dimple/detent 177 is formed of a semi-spherical recess formed in a portion of each extension rod 170 and/or extension rod 170'. Each rod dimple/detent 177 may be formed by removing, such as, for example, by machining or cutting, material from each extension rod 170 and/or extension rod 170'. Alternatively, each rod dimple/detent 177 may be formed by pressing a rod dimple/detent 177 into each extension rod 170 and/or extension rod 170'. It should be appreciated that the rod channel 175 may be formed in a manner similar to that of the spaced apart rod dimples/detents 177.

By utilizing spaced apart rod dimples/detents 177 and a rod channel 175, the strength and integrity of the extension rods 170 and 170' is maintained and the problems introduced by cut notches in existing collapsible stocks is circumvented. Because the majority of the strength of a rod is in the outer perimeter, by utilizing circular dimples/detents that are cut or pressed into the rod, the rod is more structurally sound than a rod having a large, flat cut across the rod.

In still other embodiments, each rod dimple/detent 177 may optionally be formed of a notch or other shaped recess formed in a portion of each extension rod 170 and/or extension rod 170'.

As illustrated in FIGS. 37-40, the extension rod 170 (and/or extension rod 170') includes a substantially triangular anti-rotation engagement portion 174 (including three side surfaces) and an arrangement of one or more rod dimples/detents 177, with or without an associated rod channel 175, longitudinally aligned along three discrete areas of each extension rod 170. In this exemplary embodiment, each longitudinal arrangement of one or more rod dimples/detents 177 (with or without an associated rod channel 175), corresponds to a discrete rotational position that the extension rod 170 may be positioned within relative to the stock 160, as dictated by the mating engagement of the anti-rotation engagement recesses 164 and the anti-rotation engagement portions 174.

The number of longitudinally aligned arrangements of one or more rod dimples/detents 177 (with or without an associated rod channel 175), as generally indicated by longitudinal alignment lines 176, positioned around the perimeter of each extension rod 170, corresponds to the number of potential rotational positions of the extension rod 170 relative to the stock 160. For example, if the anti-rotation engagement recesses 164 and the anti-rotation engagement portions 174 are each triangular (having three side surfaces) there will be three potential rotational positions of the extension rod 170 relative to the stock 160 and three longitudinally aligned arrangements of one or more rod dimples/detents 177 (with or without an associated rod channel 175) separated by approximately 120°. If, for example the anti-rotation engagement recesses 164 and the anti-rotation engagement portions 174 are each square or rectangular (having four side surfaces) there will be four potential rotational positions of the extension rod 170 relative to the stock 160 and four longitudinally aligned arrangements of one or more rod dimples/detents 177 (with or without an associated rod channel 175), separated by approximately 90°.

As illustrated, the first longitudinally aligned arrangements of one or more rod dimples/detents 177 provide incremental locking positions for the stock to be fully collapsed or fully extended. The second longitudinally aligned arrangements of one or more rod dimples/detents 177 provides locking positions for fully extended and fully collapsed and "locks" into deeper rod dimples/detents 177 in both of those positions. The third longitudinally aligned arrangements of one or more rod dimples/detents 177 with the stock 160 closed in the fully collapsed position, the single dimple/detent 177 allows the stock 160 to be pulled from the fully collapsed position without the need to release the lever 130, but still locks in place opened and in the fully extended position.

Once appropriately positioned, the desired longitudinally aligned arrangements of one or more rod dimples/detents 177 (with or without an associated rod channel 175) are positioned so as to interact with the one or more latch elements 140, as described herein.

It should be appreciated that the extension rods 170 and 170' may take on a number of profiles and still include structures that correspond to the rod channel 175 and the rod dimples/detents 177. For example, the extension rods 170 and 170' may optionally have a substantially octagonal, triangular, rectangular, "L" shaped profile, circular, or other profile.

The stock assembly comprises a stock 160, a cheek rest 150, and the extension rods 170 and 170'. The stock 160 comprises an elongate portion of material extending from a top end 161 to a bottom end 162. A recessed channel 165 is formed in the top end of the stock 160. In certain exemplary embodiments, the recessed channel 165 forms a semi-circular channel. Alternatively, the recessed channel 165 may form an alternate shape, primarily as dictated by the outer shape of the buffer tube 180.

As illustrated, the extension rod 170 and the extension rod 170' are attached or coupled to the stock 160 so as to extend from the stock 160. The extension rods 170 and 170' extend from the stock 160 so as to be aligned with and slidable within the cover rod apertures 118 of the latch cover 115 and the connector rod apertures 128 of the stock connector component 120.

The cheek rest 150 is formed of a substantially inverted "U" or "V" shaped portion of material that extends from a first end to a second end. The cheek rest 150 is formed so as to be permanently or releasably attached or coupled to the stock 160, proximate the first end of the cheek rest 150 and the top end 161 of the stock 160.

The cheek rest 150 is formed so as to be positioned above and at least partially around the buffer tube 180, when the buffer tube 180 is attached to an extends from the lower receiver to which the multi-position collapsible stock assembly 100 is attached. It should be appreciated that the overall size and shape of the cheek rest 150 is a design choice based upon the desired appearance and/or functionality of the cheek rest 150. Generally, the cheek rest 150 is formed so as to provide a surface for a user to position his or her cheek when the stock 160 is positioned against the user's shoulder. Thus, it should be understood that the exterior size and shape of the cheek rest 150 may be altered to provide a desired cheek weld for a user.

In exemplary embodiments wherein the cheek rest 150 is releasably attached or coupled to the stock 160, alternate shapes and sizes of cheek rest 150 can be provided such that a cheek rest 150 having a desired shape can be selected by a user.

Because of the arcuate shape of the interior of the cheek rest 150, when the cheek rest 150 is attached or coupled to the stock 160, the space provided between the recessed channel 165 and the cheek rest 150 defines an aperture 167, which allows at least a portion of the buffer tube 180 to freely slide therethrough.

As illustrated most clearly in FIGS. 27-28, the latch 130 extends from an engagement portion 132 to a protrusion portion 136. An extension shoulder 134 is disposed between the engagement portion 132 and the protrusion portion 136. At least a portion of the extension shoulder 134 extends laterally, away from the longitudinal axis $A_{LL}$ of the latch 130, beyond a width of the engagement portion 132. At least a portion of the protrusion portion 136 extends laterally, away from the longitudinal axis $A_{LL}$ of the latch 130, beyond a width of the extension shoulder 134.

When the latch 130 is positioned within the connector component cavity 122, the extension shoulder 134 interacts with side walls of the connector component cavity 122 to maintain the latch 130 within the connector component cavity 122. Thus, while maintained within the connector component cavity 122, at least a portion of the engagement portion 132 protrudes from the stock connector component 120 and the latch 130 is movable, along its longitudinal axis $A_{LL}$. Between an engaged, or locked position, as illustrated in FIG. 27, and a disengaged or unlocked position, as illustrated in FIG. 28.

In various exemplary embodiments, a latch element 140 is positioned proximate either side of the connector component cavity 122 and maintained between the connector rod apertures 128 and the protrusion portions 136. In various exemplary, nonlimiting embodiments, each latch element 140 comprises a spherical ball. Alternatively, each of said latch elements 140 may comprise a cylindrical or other portion of material.

By utilizing one or more latch elements 140, a smooth, ball bearing-type action is provided to the lock mechanism. This system provides reduced contact surface friction and smoother and easier manipulation of the components, particularly when compared to a square/rectangular notch.

When the latch 130 is in the disengaged or unlocked position, as illustrated most clearly in FIGS. 28, the protrusion portions 136 are urged so as to allow the latch elements 140 to retract further into the connector component cavity. When the latch 130 is in the engaged or locked position, as illustrated most clearly in FIGS. 27, the protrusion portions 136 urge the latch elements 140 into the connector rod apertures 128.

While the latch assembly is illustrated and described as including latch element(s) 140, it should be appreciated that the latch element(s) 140 may be replaced by one or more protrusion portions, rectangular latches, or the like. Thus, it should be understood that any device, element, or feature able to be at least partially positioned within a rod channel 175 and/or rod dimples/detents 177 may be used as or in place of a latch element 140.

Additionally, while the multi-position collapsible stock assembly 100 is illustrated as including two latch elements 140, it should be appreciated that the locking mechanism of the multi-position collapsible stock assembly 100 may only utilize a single latch element 140, positioned proximate a single side of the connector component cavity 122 and maintained between a single connector rod aperture 128 and protrusion portion 136.

One or more biasing element receiving recess(es) 138 may optionally be formed within an upper portion of the latch 130. The biasing element receiving recess(es) 138 allow one or more latch biasing element(s) 145 to be at least partially positioned therein so as to maintain alignment of the latch biasing element(s) 145 between the latch 130 and the interior of the connector component cavity 122.

In various exemplary embodiments, the biasing element(s) 145 comprise a spring. Alternatively, the biasing element(s) 145 may comprise a single spring or multiple springs, a leaf spring, a resilient portion of material, such as, for example, rubber or silicone, or any other mechanism that can store and return energy in a fashion similar to that of a spring.

In still other exemplary embodiments, the spring biasing element(s) 145 may optionally be replaced with a spring biasing element, such as, for example, a bent piece of spring steel or leaf spring. Alternatively, the spring biasing element(s) 145 may optionally be replaced with a spring biasing element, such as, for example, a resilient block or portion of material.

In certain of these exemplary embodiments, the one or more biasing element receiving recess(es) 138 are not included in the latch 130.

The biasing element(s) 145 are positioned between the latch 130 and an interior surface of the connector component cavity 122, so as to bias the latch 130 to the engaged or locked position, as illustrated in FIG. 42.

The interaction between the latch elements 140 and the connector rod apertures 128 is such that when the latch 130 is in the disengaged or unlocked position, the latch elements 140 are retracted so as to travel within the rod channels 175 of the extension rods 170 and 170'. However, while in the disengaged or unlocked position, the latch 130 limits the retraction of the latch elements 140 within the connector component cavity 122 such that the latch elements 140 protrude into the connector rod apertures 128 a sufficient distance to be maintained within the rod channel 175, thereby limiting the slidable movement of the extension rods 170 and 170' (and the cheek rest 150 and stock 160) relative to the lower receiver to which the multi-position collapsible stock assembly 100 is attached.

In the engaged or locked position, the latch 130 urges the latch elements 140 further into the connector rod apertures 128, thereby maintaining each latch element 140 within a rod dimple/detent 177.

Thus, through interaction of the latch elements 140 and the rod dimples/detents 177, the stock assembly can be releasably secured at a desired position relative to the lower receiver to which the multi-position collapsible stock assembly 100 is attached.

In various exemplary embodiments, various components of the multi-position collapsible stock assembly 100 are substantially rigid and are formed of aluminum. Alternate materials of construction of the various components of the multi-position collapsible stock assembly 100 may include one or more of the following: steel, stainless steel, titanium, and/or other metals, as well as various alloys and composites thereof, glass-hardened polymers, polymeric composites, polymer or fiber reinforced metals, carbon fiber or glass fiber composites, continuous fibers in combination with thermoset and thermoplastic resins, chopped glass or carbon fibers used for injection molding compounds, laminate glass or carbon fiber, epoxy laminates, woven glass fiber laminates, impregnate fibers, polyester resins, epoxy resins, phenolic resins, polyimide resins, cyanate resins, high-strength plastics, nylon, glass, or polymer fiber reinforced plastics, thermoform and/or thermoset materials, and/or various combinations of the foregoing. Thus, it should be understood that the material or materials used to form the various components of the multi-position collapsible stock assembly 100 is a design choice based on the desired appearance and functionality of the multi-position collapsible stock assembly 100.

It should be appreciated that certain elements of the multi-position collapsible stock assembly 100 may be formed as an integral unit (such as, for example, the stock 160 and the extension rods 170 and 170'). Alternatively, suitable materials can be used and sections or elements made independently and attached or coupled together, such as by adhesives, welding, screws, rivets, pins, or other fasteners, to form the various elements of the multi-position collapsible stock assembly 100.

It should also be understood that the overall size and shape of the multi-position collapsible stock assembly 100, and the various portions thereof, is a design choice based upon the desired functionality and/or appearance of the multi-position collapsible stock assembly 100.

Figure 33:
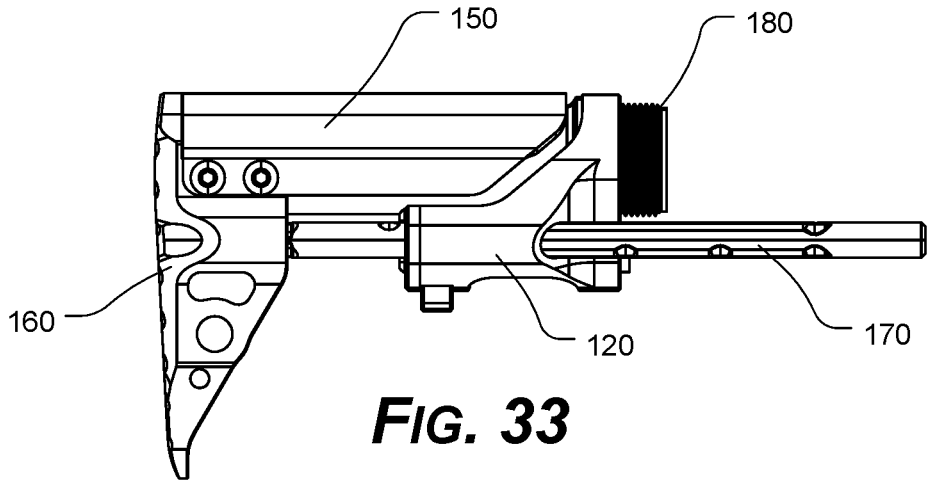
FIG. 33 illustrates a right side view of an exemplary embodiment of a multi-position collapsible stock assembly assembled together with a buffer tube, wherein the stock assembly is in a collapsed position, according to the present disclosure.
Figure 34:
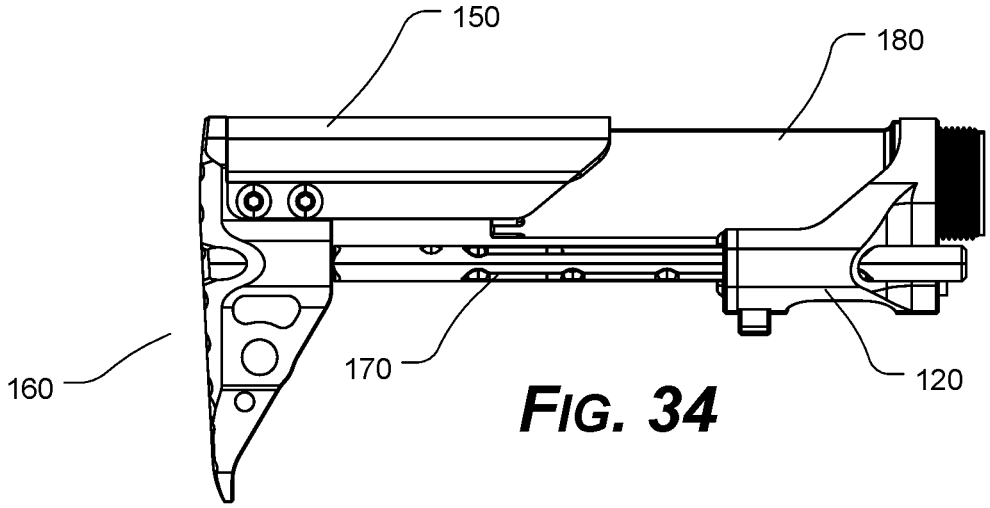
FIG. 34 illustrates a right side view of an exemplary embodiment of a multi-position collapsible stock assembly assembled together with a buffer tube, wherein the stock assembly is in a partially extended position, according to the present disclosure.

During use, the stock assembly may initially be presented in a retracted or collapsed position, as illustrated in FIG. 33. In this position, the latch 130 is in the engaged or locked position and the latch elements 140 are positioned within the rod dimples/detents 177 formed at a first terminal end 178 of the rod channel 175. The interaction of the protrusion portions 136, the latch elements 140, and the rod dimples/detents 177 is sufficient to maintain the stock assembly in the collapsed or retracted position even if a withdrawing force is applied to the stock assembly.

When a user desires to extend the stock assembly, the user merely urges the latch 130 upward, along the longitudinal axis $A_{LL}$, to the disengaged or unlocked position. Because of the convenient position of the engagement portion 132 of the latch 130, intentional manipulation of the latch 130 can be accomplished easily, with the user's finger, thumb, or another surface.

As the latch 130 is urged toward the disengaged or unlocked position, the protrusion portions 136 allow the latch elements 140 to retract into the connector component cavity 122 a sufficient distance so as to be removed from the rod dimples/detents 177 but maintained within the rod channel 175. Thus, the extension rods 170 and 170' can be slidably withdrawn from the connector rod apertures 128 and the cover rod apertures 118, a distance permitted by the length of the rod channel 175 and the rod dimple/detent positioned at the second terminal end 179 of the rod channel 175.

In certain exemplary, nonlimiting embodiments, the distance from the first terminal end 178 of the rod channel 175 to the second terminal end 179 of the rod channel 175 is approximately 3 inches. Alternatively, the distance from the terminal ends may be greater or less than 3 inches and may be, for example, 2-10 inches or more.

When the user no longer urges the latch 130 to the unlocked or disengaged position, the spring bias of the latch biasing element(s) 145 urges the latch 130 toward the engaged or locked position, such that the latch elements 140 may continue to allow slidable movement of the extension rods 170 and 170' until the latch elements 140 reach a rod dimple/detent 177. Upon reaching a rod dimple/detent 177, the spring biasing force of the latch biasing element(s) 145 urges the latch elements 140 into the rod dimples/detents 177, thereby locking the stock assembly into a given position relative to the lower receiver to which the multi-position collapsible stock assembly 100 is attached.

Figure 35:
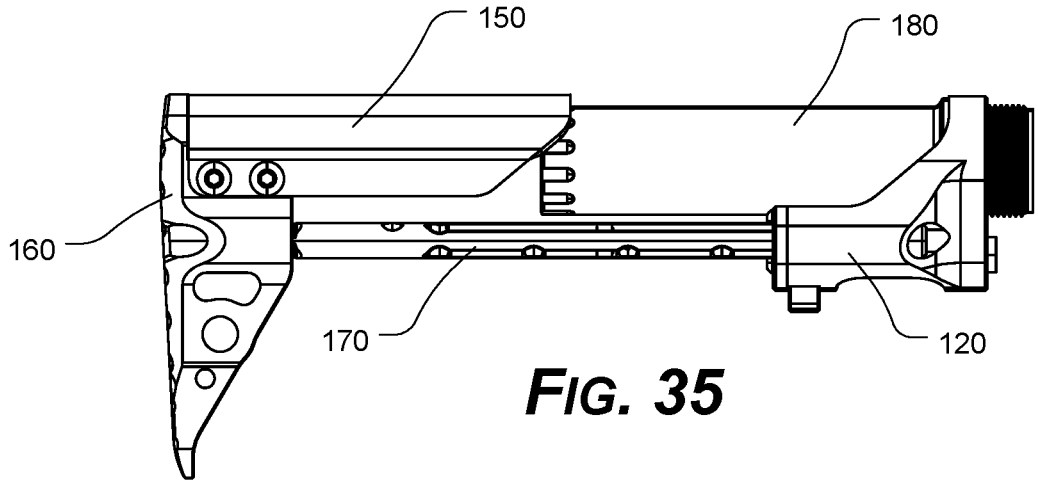
FIG. 35 illustrates a right side view of an exemplary embodiment of a multi-position collapsible stock assembly assembled together with a buffer tube, wherein the stock assembly is in a fully extended position, according to the present disclosure.
Figure 36:
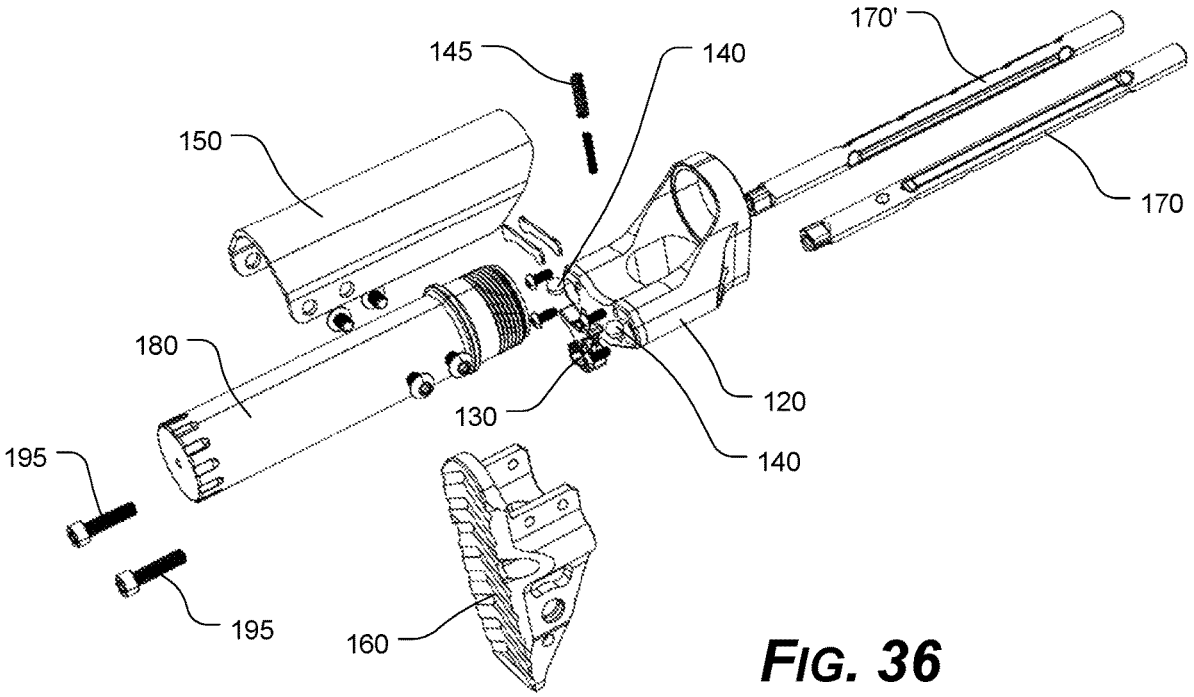
FIG. 36 illustrates an exploded perspective view of the components of an exemplary embodiment of a multi-position collapsible stock assembly, according to the present disclosure.
Figure 37:
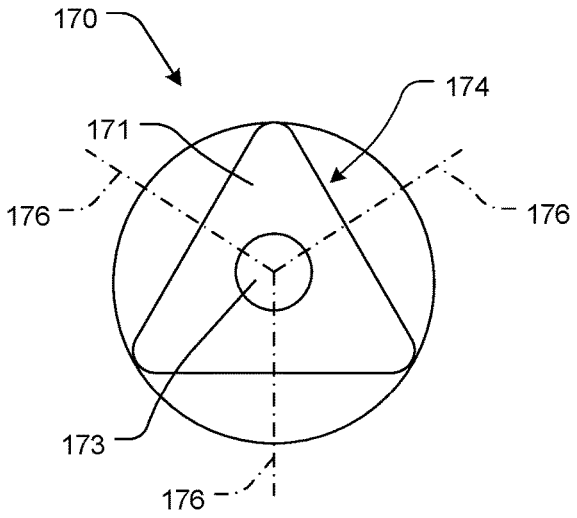
FIG. 37 illustrates a front view of an alternative exemplary embodiment of an extension rod, according to this invention.
Figure 38:
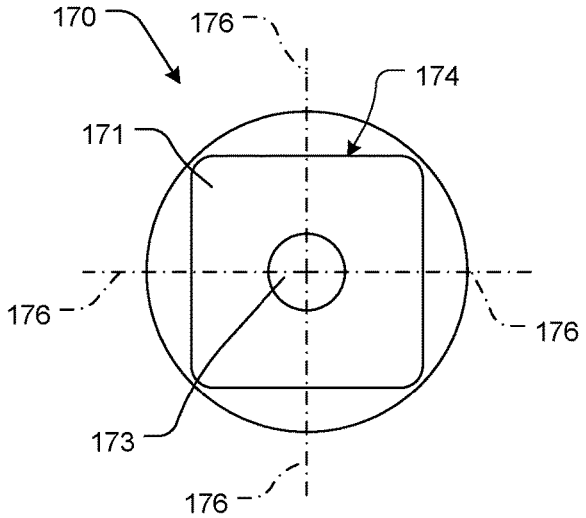
FIG. 38 illustrates a front view of an alternative exemplary embodiment of an extension rod, according to this invention.
Figure 39:
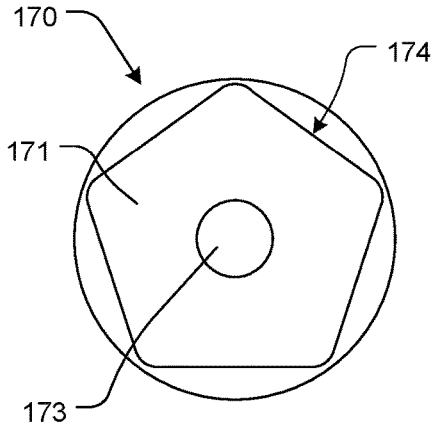
FIG. 39 illustrates a front view of an alternative exemplary embodiment of an extension rod, according to this invention.
Figure 40:
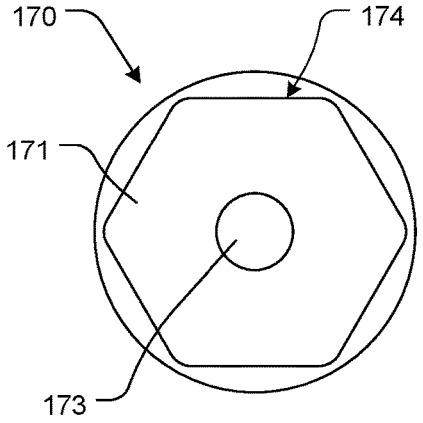
FIG. 40 illustrates a front view of an alternative exemplary embodiment of an extension rod, according to this invention.

FIG. 33 illustrates the stock assembly in a fully collapsed position, while FIG. 35 illustrates the stock assembly in a fully extended position, with a particular set of extension rods 170 and 170' attached or coupled in a given rotational position relative to the stock 160. It should be appreciated that the fully collapsed position, partially collapsed position, or fully extended position may differ, based upon the rotational position of a given set of extension rods 170 and 170'.

While the present disclosure has been described in conjunction with the exemplary embodiments outlined above, the foregoing description of exemplary embodiments of the disclosure, as set forth above, are intended to be illustrative, not limiting and the fundamental disclosure should not be considered to be necessarily so constrained. It is evident that the present disclosure is not limited to the particular variation set forth and many alternatives, adaptations modifications, and/or variations will be apparent to those skilled in the art.

Furthermore, where a range of values is provided, it is understood that every intervening value, between the upper and lower limit of that range and any other stated or intervening value in that stated range is encompassed within the present disclosure. The upper and lower limits of these smaller ranges may independently be included in the smaller ranges and is also encompassed within the present disclosure, subject to any specifically excluded limit in the stated range. Where the stated range includes one or both of the limits, ranges excluding either or both of those included limits are also included in the present disclosure.

It is to be understood that the phraseology of terminology employed herein is for the purpose of description and not of limitation. Unless defined otherwise, all technical and scientific terms used herein have the same meaning as commonly understood by one of ordinary skill in the art to which the present disclosure belongs.

In addition, it is contemplated that any optional feature of the inventive variations described herein may be set forth and claimed independently, or in combination with any one or more of the features described herein.

Accordingly, the foregoing description of exemplary embodiments will reveal the general nature of the present disclosure, such that others may, by applying current knowledge, change, vary, modify, and/or adapt these exemplary, non-limiting embodiments for various applications without departing from the spirit and scope of the present disclosure and elements or methods similar or equivalent to those described herein can be used in practicing the present disclosure. Any and all such changes, variations, modifications, and/or adaptations should and are intended to be comprehended within the meaning and range of equivalents of the disclosed exemplary embodiments and may be substituted without departing from the true spirit and scope of the present disclosure.

Also, it is noted that as used herein and in the appended claims, the singular forms "a", "and", "said", and "the" include plural referents unless the context clearly dictates otherwise. Conversely, it is contemplated that the claims may be so-drafted to require singular elements or exclude any optional element indicated to be so here in the text or drawings. This statement is intended to serve as antecedent basis for use of such exclusive terminology as "solely", "only", and the like in connection with the recitation of claim elements or the use of a "negative" claim limitation(s).

What is claimed is:

1. A multi-position collapsible stock assembly, comprising:

at least one extension rod, wherein said at least one extension rod includes an anti-rotation engagement portion formed proximate a first end of said extension rod, wherein a longitudinal arrangement of one or more spaced apart rod dimples/detents is longitudinally aligned along three or more areas of said at least one extension rod, wherein each longitudinal arrangement of one or more spaced apart rod dimples/detents corresponds to a discrete rotational position of said extension rod relative to a stock;

a stock having at least one anti-rotation engagement recess formed therein, wherein said anti-rotation engagement recess of a stock corresponds to said anti-rotation engagement portion such that said first end of said extension rod of said extension rod is at least partially positioned within a portion of a corresponding anti-rotation engagement recess and engagement between said anti-rotation engagement recess and said anti-rotation engagement portion resists rotational movement of said extension rod relative to said stock; and a stock connector component, wherein at least one extension rod aperture is formed through said stock connector component, wherein each extension rod aperture is formed so as to slidably receive at least a portion of one of said extension rods, wherein said stock connector component includes interior side walls defining a connector component cavity formed so as to receive at least a portion of a latch therein, wherein said connector component cavity extends to at least one rod aperture formed therethrough, wherein each rod aperture is formed so as to be aligned with a corresponding extension rod aperture, wherein said latch extends from an engagement portion to a protrusion portion, wherein said latch is movable, along its longitudinal axis, between an engaged position and a disengaged position, wherein when said latch is in said engaged position, said protrusion portion urges at least one latch element into said rod aperture a distance that allows each latch element to seat into said spaced apart rod dimples/detents of said at least one extension rod, and wherein when said latch is in said disengaged position, said protrusion portion allows said at least one latch element to retract from said spaced apart rod dimples/detents.

2. The multi-position collapsible stock assembly of claim 1, wherein a fastener aperture extends from each of said at least one anti-rotation engagement recess such that a fastener is positionable through at least a portion of said faster aperture to engage a fastener recess formed in said first end of said extension rod to releasably attach or couple said extension rod to said stock.

3. The multi-position collapsible stock assembly of claim 1, wherein each anti-rotation engagement portion includes one or more surfaces forming a less than circular anti-rotation engagement portion.

4. The multi-position collapsible stock assembly of claim 1, wherein sidewalls of each anti-rotation engagement recess form an interior shape that matingly corresponds to sidewalls of each of said anti-rotation engagement portions.

5. The multi-position collapsible stock assembly of claim 1, wherein each anti-rotation engagement portion includes one or more surfaces forming or defining a substantially triangular shape.

6. The multi-position collapsible stock assembly of claim 1, wherein each anti-rotation engagement portion includes one or more surfaces forming or defining a substantially square, rectangular, pentagonal, hexagonal, or oval shape.

7. The multi-position collapsible stock assembly of claim 1, wherein one or more surfaces forming or defining said anti-rotation engagement recess of said stock generally correspond to one or more surfaces forming or defining said anti-rotation engagement portion.

8. The multi-position collapsible stock assembly of claim 1, wherein engagement between said anti-rotation engagement recess and said anti-rotation engagement portion maintains said extension rod in a desired rotational position relative to said stock.

9. The multi-position collapsible stock assembly of claim 1, wherein each rod dimple/detent is formed of a semi-spherical recess formed in a portion of said at least one extension rod.

10. The multi-position collapsible stock assembly of claim 1, wherein each rod dimple/detent is formed of a notch or recess formed in a portion of said at least one extension rod.

11. The multi-position collapsible stock assembly of claim 1, wherein said extension rod includes a substantially triangular anti-rotation engagement portion and an arrangement of one or more spaced apart rod dimples/detents longitudinally aligned along three areas of each extension rod.

12. The multi-position collapsible stock assembly of claim 1, wherein each longitudinal arrangement of one or more spaced apart rod dimples/detents includes a rod channel formed between at least two of said rod dimple/detents.

13. The multi-position collapsible stock assembly of claim 1, wherein a rod channel is formed along at least a portion of each said longitudinal arrangement of one or more rod dimples/detents, and wherein said rod dimple/detents are formed at terminating ends of said rod channel.

14. The multi-position collapsible stock assembly of claim 1, wherein a rod channel is formed along at least a portion of each said longitudinal arrangement of one or more rod dimples/detents, and wherein each rod channel includes a rod dimple/detent formed at each terminating end of said rod channel.

15. The multi-position collapsible stock assembly of claim 1, wherein two or more spaced apart rod dimples/detents are formed along said rod channel.

16. The multi-position collapsible stock assembly of claim 1, wherein a number of said longitudinal arrangement of one or more spaced apart rod dimples/detents corresponds to said number of potential rotational positions of said extension rod relative to said stock.

17. The multi-position collapsible stock assembly of claim 1, wherein said longitudinal arrangement of one or more spaced apart rod dimples/detents are positioned around a perimeter of each said at least one extension rod.

18. The multi-position collapsible stock assembly of claim 1, wherein when said latch is in said disengaged position, said protrusion portion allows said at least one latch element to retract into said rod channels of said at least one extension rod.

19. A multi-position collapsible stock assembly, comprising:

at least one extension rod, wherein said at least one extension rod includes an anti-rotation engagement portion formed proximate a first end of said extension rod, wherein a longitudinal arrangement of one or more spaced apart rod dimples/detents is longitudinally aligned along a plurality of areas of said at least one extension rod, wherein each longitudinal arrangement of one or more spaced apart rod dimples/detents corresponds to a discrete rotational position of said extension rod relative to a stock;

a stock having at least one anti-rotation engagement recess formed therein, wherein said anti-rotation engagement recess of a stock corresponds to said anti-rotation engagement portion such that engagement between said anti-rotation engagement recess and said anti-rotation engagement portion resists rotational movement of said extension rod relative to said stock; and a stock connector component, wherein at least one extension rod aperture is formed through said stock connector component, wherein each extension rod aperture is formed so as to slidably receive at least a portion of one of said extension rods, wherein said stock connector component includes a latch, wherein said latch is movable, between an engaged position and a disengaged position, wherein when said latch is in said engaged position, a protrusion portion urges at least one latch element into said rod aperture a distance that allows each latch element to seat into said spaced apart rod dimples/detents of said at least one extension rod, and wherein when said latch is in said disengaged position, said protrusion portion allows said at least one latch element to retract from said spaced apart rod dimples/detents.

20. A multi-position collapsible stock assembly, comprising:

at least one extension rod, wherein said at least one extension rod includes an anti-rotation engagement portion formed proximate a first end of said extension rod, wherein a longitudinal arrangement of one or more spaced apart rod dimples/detents is longitudinally aligned along a plurality of areas of said at least one extension rod, wherein each longitudinal arrangement of one or more spaced apart rod dimples/detents corresponds to a discrete rotational position of said extension rod relative to a stock; and a stock having at least one anti-rotation engagement recess formed therein, wherein said anti-rotation engagement recess of a stock corresponds to said anti-rotation engagement portion such that engagement between said anti-rotation engagement recess and said anti-rotation engagement portion resists rotational movement of said extension rod relative to said stock.

* * * * *